US005085161A

United States Patent [19]

Cuneo et al.

[11] Patent Number: 5,085,161

[45] Date of Patent: Feb. 4, 1992

[54] VESSEL HULL AND CONSTRUCTION METHOD

[75] Inventors: Joseph Cuneo, Hastings on the Hudson, N.Y.; Charles Garland, Williamsburg; Richard A. Goldbach, Norfolk, both of Va.; Robert D. Goldbach, Millford, Pa.; Frank E. McConnell, Norfolk, Va.; Edmund G. Tornay, New York, N.Y.

[73] Assignees: Metro Machine Corporation, Norfolk, Va.; Marinex International, Inc., Hoboken, N.J.

[21] Appl. No.: 532,329

[22] Filed: Jun. 5, 1990

[51] Int. Cl.[5] ..... B63B 3/02

[52] U.S. Cl. ..... 114/65 R; 114/77 R

[58] Field of Search ..... 114/65 R, 77 R, 56, 114/77 A, 74 A, 79 R, 79 W, 80; 29/428, 429

[56] References Cited

U.S. PATENT DOCUMENTS

| | | | |
|---|---|---|---|
| 2,353,260 | 7/1944 | Paulsen | 114/79 |
| 3,011,252 | 12/1961 | Svensson | 29/429 |
| 3,447,503 | 6/1969 | Myers | 114/77 |
| 3,487,807 | 1/1970 | Van Der Hoeven | 114/77 |
| 3,656,680 | 4/1972 | Nomura | 228/44 |
| 3,698,344 | 10/1972 | Maeda | 114/77 R |
| 3,703,153 | 11/1972 | Maeda | 114/77 R |
| 3,704,822 | 12/1972 | Nomura | 228/25 |
| 3,753,413 | 8/1973 | Ichikawa et al. | 114/65 |
| 3,872,815 | 3/1975 | Kawai et al. | 114/65 R |
| 3,875,887 | 4/1975 | Fittrip et al. | 114/65 R |
| 3,886,883 | 6/1975 | Odaka | 114/65 R |
| 4,003,326 | 1/1977 | Horii et al. | 114/65 R |
| 4,267,789 | 5/1981 | Ivanov et al. | 114/65 R |
| 4,341,175 | 7/1982 | Ivanov | 114/65 R |
| 4,476,797 | 10/1984 | Ivanov et al. | 114/65 R |
| 4,491,081 | 1/1985 | Ivanov | 114/65 R |
| 4,548,154 | 10/1985 | Murata et al. | 114/355 |
| 4,573,422 | 3/1986 | Murata et al. | 114/65 |
| 4,638,754 | 1/1987 | Tornay | 114/79 R |
| 4,660,491 | 4/1987 | Murata et al. | 114/65 |
| 4,674,430 | 6/1987 | Murata et al. | 114/355 |
| 4,712,499 | 12/1987 | Harvguchi et al. | 114/65 R |

FOREIGN PATENT DOCUMENTS

| | | |
|---|---|---|
| 2483877 | 12/1981 | France . |
| 8702086 | 4/1987 | PCT Int'l Appl. . |
| 20479 | 9/1913 | United Kingdom . |
| 2143182 | 2/1985 | United Kingdom . |

OTHER PUBLICATIONS

"Great Lakes Ore Transportation System"(description of the vessel and construction method which the former Erie yard was designed to manufacture and practice).

*Primary Examiner*—Jesus D. Sotelo
*Assistant Examiner*—Stephen P. Avila
*Attorney, Agent, or Firm*—Cushman, Darby & Cushman

[57] ABSTRACT

The parallel midbody for the hull of a tanker is fabricated of modules, each made of double-walled longitudinal subassemblies welded to one another and to a bulkhead. The subassemblies are made of outer cylindrically curved plates welded edge to edge, and inner cylindrically curved plates welded edge to edge. Longitudinal rib plates are extended between and are welded into joints between curved plates in the inner and outer hulls. The curved plates are convex towards the exterior of the vessel. At respective transitions between the bottom and sides, the inner and outer hulls have bilge radii which approximate in size the radii of curvature of others of the plates including ones both adjacent to and remote from the bottom-to-side transitions. A fixture for facilitating welding of the T-joints of the subassemblies is provided. The subassemblies and modules are fabricated in an up-ended orientation. Each successively completed module is tilted-over and joined to the growing midbody with the aid of a variable buoyancy barge and a caisson pontoon.

31 Claims, 23 Drawing Sheets

VESSEL HULL AND CONSTRUCTION METHOD

BACKGROUND OF THE INVENTION

In the U.S. Pat. No. 4,638,754, to Tornay, issued Jan. 27, 1987, there is disclosed a vessel hull and construction method, which is said to be particularly suitable for vessels of double hull construction, such as gas tankers with almost complete double hulls, and oil and product tankers with double bottoms. The disclosed system is said to be suitable for construction of commercial and naval ships and barges, and to be adaptable to provide any arrangement of decks and bulkheads within the hull.

In the construction system disclosed in the Tornay patent, the plating of the outer hull and bulkheads is constructed of standard-sized steel plates, usually about 8 feet by 40 feet, which are rolled to a slight cylindrical curvature, the axis of which is parallel to the longer edge. On the shell of the vessel, the plates are arranged with their long edges longitudinal. The plates are arranged with the curvature inwards or outwards, depending on the direction of the highest local load. The curved plates are then provided with a reverse bend or recurve along the midline between the long longitudinal edges. The short transverse edges and the long longitudinal edges are butt-welded together. To the midline of the plates at the recurve are welded longitudinal steel girders such as L or T-beams which match the recurved portion of the curved plates and are of sufficient depth and section modulus to span the distance between transverse bulkheads or deep webs. The local pressure loading on the plate causes a tensile or compressive stress, depending on the direction of the load, uniformly across the thickness of the curved plate in the same way that a cylindrical pressure vessel is stressed by an internal pressure. Because the plating is not subjected to local panel bending, closely spaced primary stiffeners are said to be not required. In addition to efficiently absorbing local pressure forces such as transverse membrane stresses, the curve and reverse curve also are said to provide stiffness in the longitudinal direction needed to resist compressive buckling caused by longitudinal hull bending stresses. An additional efficiency is said to be obtained from the girders along the midline of the curved plates, and thus contribute to the principal section modulus of the hull needed to resist longitudinal bending.

Such details of the construction as orientation of each module while being constructed, the method and means for performing the welding of module elements to one another, and of modules to one another, jigs or fixtures useful during module fabrication or joining, and module handling and manipulation apparatus and techniques do not appear to be presented in the Tornay patent, leading one to conclude that no non-conventional methods or means for construction were contemplated.

In a vessel hull, the ability of an unreinforced curved steel to resist pressure forces, bending, and buckling is determined by well known and classic criteria and is a direct function of plate width, length and thickness and an indirect function of radius of curvature.

Some flat plate tanker designs exist in which there is no transverse structure reinforcing the inner and outer hulls except for transverse bulkheads. The elimination of transverse structure in such designs is not therefore a new idea. However, the use of curved plate results in a buildup of excessive transverse forces at the lower corners (bilges) of the vessel which would normally require the installation of transverse deep webs, as contemplated in the Tornay patent.

Details of the design of a curved plate vessel which would eliminate the need for deep webs are not disclosed in the Tornay patent, nor are details which would eliminate the need to recurve the curved plate along its midline.

The use of a flat plate duct keel and flat plate upper corner box girders which permit the use of standardized curved plate modules in a wide range of double hull tanker sizes is not disclosed in the Tornay patent.

The use of a curved plate midbody in combination with flat plate bow and stern ends of a double hull tanker is not disclosed in the Tornay patent.

Shipfitting is the most technically demanding and time-consuming element of subassembling vessel hull sections. Shifting, holding, bending and trimming of plates and other elements is necessary so that welding can be satisfactorily accomplished and so that subassemblies can be assembled to one another to provide a hull that meets specifications.

The techniques of electroslag/electrogas welding generally require the use of a continuous cooling shoe on the back-sides of T-joints while welding is being accomplished. In prior art construction techniques using electroslag/ electrogas welding, efficiency has been penalized due to the time needed to set-up and provide cooling water plumbing to the cooling shoe.

Shipfitting and welding of vessel hulls as heretofore practiced in even the most highly rationalized construction facilities has necessitated that the construction workers have a lot of training and possess a wide range of skills. Increasing scarcity of trained workers possessing such a broad range of skills has driven-up labor costs to the point where vessel hulls cannot be profitably fabricated in many areas.

Conventional fabrication techniques also have made extensive use of temporary shipfitting devices, many of which are welded-on in normal practice, necessitating a considerable amount of surface preparation and painting after the devices are disconnected from the work.

Also in the prior art are assembly lines for flat panels. A typical panel assembly line comprises a long conveyor along which are mounted devices for assembling and welding steel sheets into panels each weighing, for instance, from 10 to 50 tons. Flat panels, when assembled to provide hulls, require the use of transverse framing crossing longitudinal framing.

If vessel hulls are constructed in modules that are sequentially connected to form the hull, and an attempt is made to do so on land, the land crane that would need to be used is expensive, and, should it become no longer needed due to eventual curtailing of the project, can be expected to have lost considerable value.

Land-based assembly might use a plurality (e.g., from six to ten) mobile cranes on pile-supported tracks. These are expensive to buy, install and maintain.

Two shipyards (neither of which is still operating), known to the present inventors, formerly used modular assembly and erection procedures for constructing vessel hulls.

One of these, the Erie yard of Litton Industries, built 1000-foot long ore carrier midbodies. (A tanker/carrier "midbody" is the main portion of the length of such a vessel, but for the bow and stern sections, that is of substantially constant transverse cross-sectional size and shape.)

At the Erie yard, midbody modules were each built in an upended spatial disposition (one which will be referred to herein as being "vertical"). These modules were built in the extreme end of the same graving dock that was used for joining the modules to one another and for joining purchased bow and stern units to the midbody. The modules weighed 600 tons each, and an electro-hydraulic jacking device was used for forming the individual upended modules over into a horizontal orientation for serial joining to form the midbody. The hydraulic jacking device, one of the largest ever made, was expensive to purchase, install and maintain. Failure of the device would have posed a serious threat to human life, and to the graving dock, which was the most expensive and indispensable facility at the Erie yard.

(Graving docks, such as the one at Erie, use stationary civil construction including pilings, concrete, fill, and piping embedded in the concrete of the dock floor. Pumps are continuously operated for relieving the dock, through the pipes, of water seepage through the dock floor. A graving dock functions much as if it were a bathtub with a gate at one end to let a vessel in and out. The level of the floor is sufficiently below the level of the adjoining body of water to permit the vessel being built or dry-docked to float clear of the blocking on the floor of the dock when the graving dock is filled with water by opening valves connected to that adjoining body of water. The concrete floor of a graving dock typically is supported by piling that is adequate to support the full weight of the vessel when the graving dock is empty of water. The perimeter wall of a graving dock, is constructed high enough to keep water out (except for seepage), at the highest tide for which the facility is designed to encounter.)

The module assembly area at the Erie yard was not accessible to heavy-lift floating derricks. Therefore, each subassembly had to be lifted using a land crane, often reaching to or beyond the maximum for which it was designed. The crane lifting and reaching capabilities acted as limits on the size and weight of individual midbody modules which could be fabricated at the Erie yard.

The fact that the graving dock at the Erie yard was constructed in place and fixed in its location meant that it had limited residual value, it could not be floated away and used elsewhere once there was no longer need for it at Erie.

One other shipyard at which modular assembly and erection procedures were used for constructing carrier/tanker vessel hulls, was the Arandal yard in Gotverken, Sweden. At the Gotverken yard, oil tankers were built in a graving dock. One end of the graving dock was located inside an enclosed building. Modules were assembled horizontally, one after another, at a single station located in the building, and then moved out into position in the open end of the graving dock. Probably the movement was accomplished on rollers. Because the modules were constructed horizontally, there was reduced accessibility for steel assembly and piping installation, compared with vertical construction, where a module being constructed is open at the top rather than at the side.

Caissons are commonly used for underwater work, e.g., for the construction of bridge piers. It is believed by the present inventors that caissons may have been used in the past for joining vessel hull sections.

Large underwater grids have been used under floating dry docks to stabilize them as ships were transferred off a floating dry dock onto land, or from land onto a floating dry dock. A ship construction facility known as the Ingalls launching pontoon uses this technique.

The task of inspecting and maintaining conventional double-bottomed vessel hulls incorporated in carriers for bulk fluids and/or particulate material such as oil, liquified gases, chemicals, ore and grain is difficult. With traditional egg crate-like stiffening structures provided longitudinally and transversely between the bottoms, the process is one of climbing-over, ducking-under and squeezing through girders and plates in a constantly couched position, with poor ventilation (unless "moon suits" are worn), poor footing, little to hold onto for support, while needing to carry illumination means, and trying one's best to locate anomalies in surfaces the expected color of which is itself dirt colored or rust colored.

SUMMARY OF THE INVENTION

The present invention provides a simplified double-bottomed vessel hull structure preferably using slightly curved inner and outer hull plating, in combination with widely spaced girders. The plate curvature substantially reduces the need to locally reinforce the hull plating against buckling. In many instances, transverse reinforcing structure, except for bulkheads, can be omitted from the midbody.

A ducted keel, which is preferably provided, preferably contains all fore and aft ballast piping. Cargo piping preferably is run through the transverse bulkheads above the inner bottom. Ventilation of the double-hull compartments can be provided by portable mechanical blowers mounted above deck, onto vertical standpipes which connect into the ballast tank transverse piping.

The preferred absence of transverse structure except for the bulkheads eliminates a major cause for inner hull failure in the event of tanker grounding. (Transverse structure, if provided, being transverse to the direction of travel is subject to deflecting aft at the base during grounding, tending to tear the inner hull to which it is attached.)

The double-hull construction provided in accordance with the preferred embodiment can be realized with less welding and burning in later production stages. This permits fully enclosed and automated shot blasting and painting of much of the surface during early stages of production. As a result of painting being performed under more closely controlled environmental conditions, the initial coating has a longer life and release of abrasive blasting dust and paint solvents to the atmosphere can be significantly reduced.

The principles of the present invention may be used to provide a double-hull vessel which utilizes an amount of steel that is comparable to that needed for construction of a conventional single-hull segregated ballast tanker of the same size, whereas double-hull tankers of conventional construction require 5 to 15 percent more steel.

The principles of the invention may be used for converting existing single hull tankers by midbody replacement with double-hull midbodies produced in accordance with the present invention, and reuse of the pre-existing bow and stern sections, thus recovering useful life from existing structures which might otherwise need to be scrapped.

As presently contemplated, the principles of the invention can be used to provide a hull for a vessel as large as a 300,000 DWT tanker. The vessel preferably includes a double hull not only on the bottom, but also on the sides. Inner hull spacing from the outer hull at the sides and bottom may be as much as 7 feet, 3 inches (i.e., slightly greater than 2 meters). Transverse bulkheads are provided every 40–60 feet, e.g., 48 feet along the length of the midbody. Longitudinal girders are spaced 8 feet apart.

When designing a double-hull vessel having a preferred standard interbottom spacing of, e.g., about 2 meters, and 8-foot girder spacing, using the principles of the present invention, the capacity may be readily customized from 80,000 to nearly 300,000 DWT by adjusting for differences in vessel beam and depth, through a combination of adding or deleting 8-foot wide modules, varying the size of keel and main deck centerline structure and deck edge box girders (all of which may be of conventional construction). Other design modules can be used with greater or lesser dimensions of inner bottom spacing, girder spacing and transverse bulkhead spacing to accommodate designs for vessel sizes from the smallest to the largest double hull tankers or barges.

In the preferred construction, the interhull spacing is made no more than bout 2 meters in order to limit the loss of buoyancy should the outer hull be punctured. Further, the longitudinal girder at the top of the bilge preferably is made tight, thereby creating separate side and bottom ballast tanks. This preferred structure will permit rapid evacuations of a flooded interbottom using compressed air, so as to create a buoyancy-providing air bubble between the hulls above the damaged outer hull plating.

In a ship which utilizes curved hull plating, the construction method of the present invention eliminates all transverse structure in the midbody (except for transverse bulkheads), by utilizing a bilge radius which is similar to the radius of curvature of the curved hull plating. A novel structure of underdeck longitudinal girders also is preferably provided.

Recurvature of cured plates formerly thought to be needed or desirable according to the aforementioned U.S. patent of Tornay is avoided, with resulting savings, by instead aligning and welding longitudinal girders into longitudinal weld seems of curved inner and outer hull plating at T-joints.

The double hull thus has steel plate as its primary structural members, with the need for longitudinal T-bars, I-beams and similar structural shapes being avoided.

The invention provides a novel method for constructing the double-hulled midbody of a cargo tanker by fabricating module subassemblies vertically in a fixture, assembling the subassemblies into a module vertically, launching each module vertically then righting each module and joining each successively to the growing structure, with conventional bow and stern sections being joined to the opposite ends of the midbody. Each module preferably is approximately 50 feet tall as fabricated, and therefore about 50 feet long when righted.

Each module may incorporate six similar, if not identical, module subassemblies, thereby permitting a high degree of standardization of steel parts in the cargo tank sections of double hull tankers.

(The term "tanker" is used generically herein, without regard to whether the vessel with carry liquid, gaseous and/or particulate solid material or any combination thereof.)

The vessel hull and construction method of the present invention uses less steel than is conventionally used for producing a double-hulled tanker of the same DWT capacity, requires less labor hours per ton of steel fabricated into hull, can use a higher percentage of automatic welding, including vertical electroslag and/or electrogas welding (with resulting higher quality and lower cost), reduces the need for higher-cost steel shapes such as I-beams and T-bars, substantially reduces the absolute number of pieces of steel which must be handled and assembled (thereby significantly reducing cost and time), reduces total welding necessary, facilitates and reduces the cost of blasting and painting (and abatement of environmental impact of these processes), and permits improvement in the quality of finished painting for the vessel hull.

In a tanker which has hull plating that is curved, hydrostatic forces and liquid cargo or ballast pressure cause a deflection perpendicular to the curved plate which, in turn, causes lateral deflection at the edges of the plate. The lateral forces created in this manner are offsetting at the edges of two adjacent plates which are in the same lateral plane, but at the lower corners (bilges) where the additive lateral deflections are maximum, either the longitudinal bilge structure would need to be massive in order to transmit the resulting lateral forces to the transverse bulkheads, or intermediate transverse structure between bulkheads would be needed, according to conventional design.

A novel aspect of the present invention is that by utilizing a bilge radius for both inner and outer hull which is approximately the same as the radius of curvature of the other plating, the lateral forces caused by the additive lateral deflections can be transferred to the transverse bulkheads through reasonable-thickness bilge plating only.

The elimination of all transverse reinforcement of inner and outer hull except for bulkheads is possible for the entire length of the hull which is built parallel (the so-called "parallel midbody"), which comprises about 75 percent of the length of the cargo tank section of a typical tanker. Toward the bow and stern of the vessel where the hull shape curves inward, the bilge radius necessarily has to be made larger in order to maintain fairness of hull lines. This particular area needs to have either intermediate transverse structure or massive bilge structure if the curved hull plating is retained. (One alternative is to convert existing tankers by replacing only the parallel midbody portion and retaining the shaped ends made up of conventional flat hull plating and transverse structure.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION OF THE PREFERRED EMBODIMENTS

Figure 1:
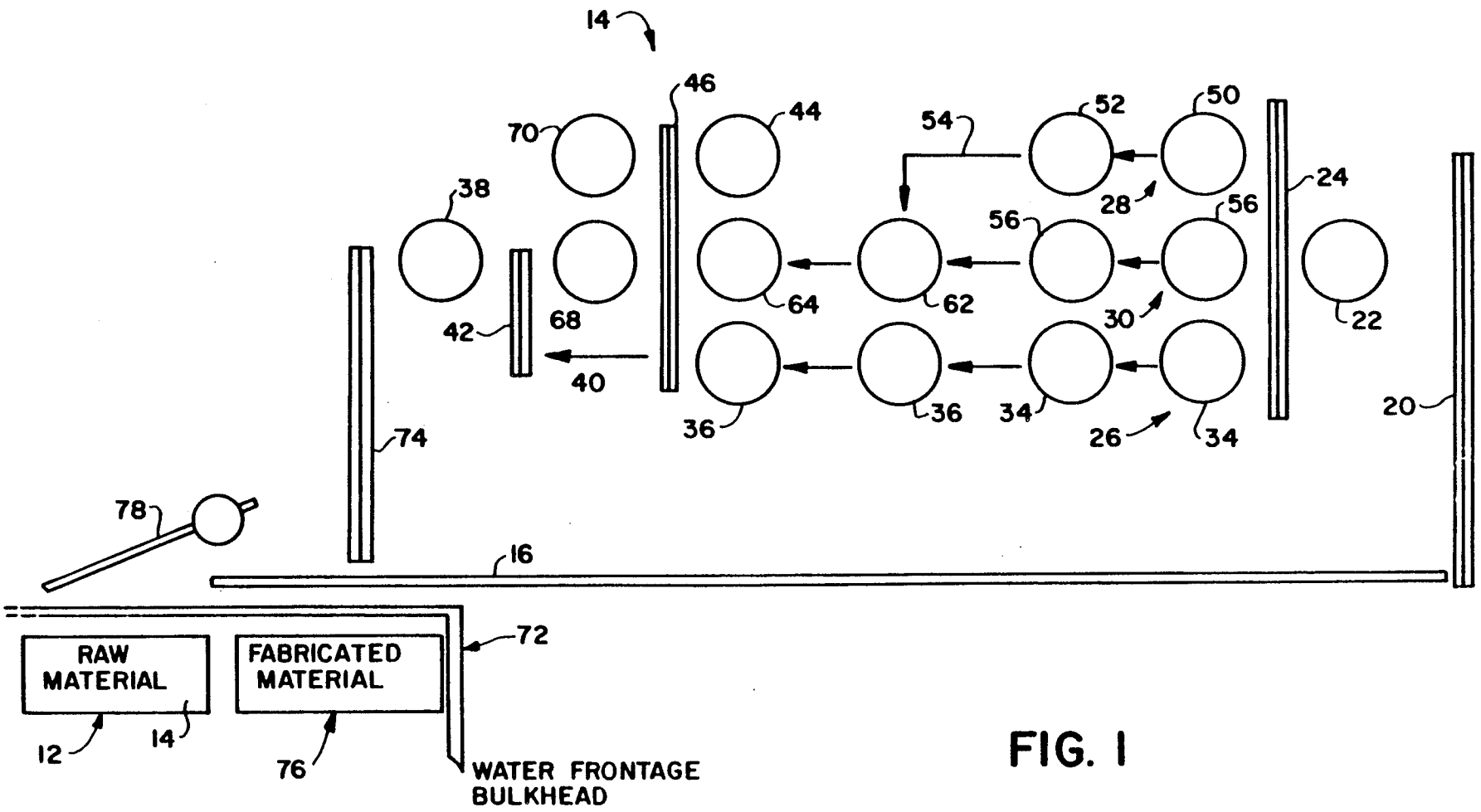
FIG. 1 is a schematic top-plan view of a production line for prefabricated panels for double-hull module longitudinal subassemblies.

Production of the double-hulled vessel midbody for a vessel hull of the present invention preferably begins on the production line that is schematically depicted at 10 in FIG. 1.

Raw steel plate, most of it 0.5 to 1.0 inch thick and approximately 8 feet wide and 48 feet long is procured from a steel mill, received by barge 12 and stored flat as raw material 14. As processing begins, steel plates are individually transferred from the barge 12 onto a roller conveyor 16 using an electromagnet-type grasping device-equipped crane (not shown). At the opposite end of the conveyor 16, the steel plates are transferred to a trolley car 20 which takes them to a steel shot abrasive cabinet 22 where mill scale is conventionally removed from the plate. A further trolley car 24 transfers the descaled plates to one of three fabricating lines 26, 28, 30.

The line 26 processes about 45 percent of the incoming tonnage of plates 14 and produces curved longitudinal panels 32.

Figure 2:
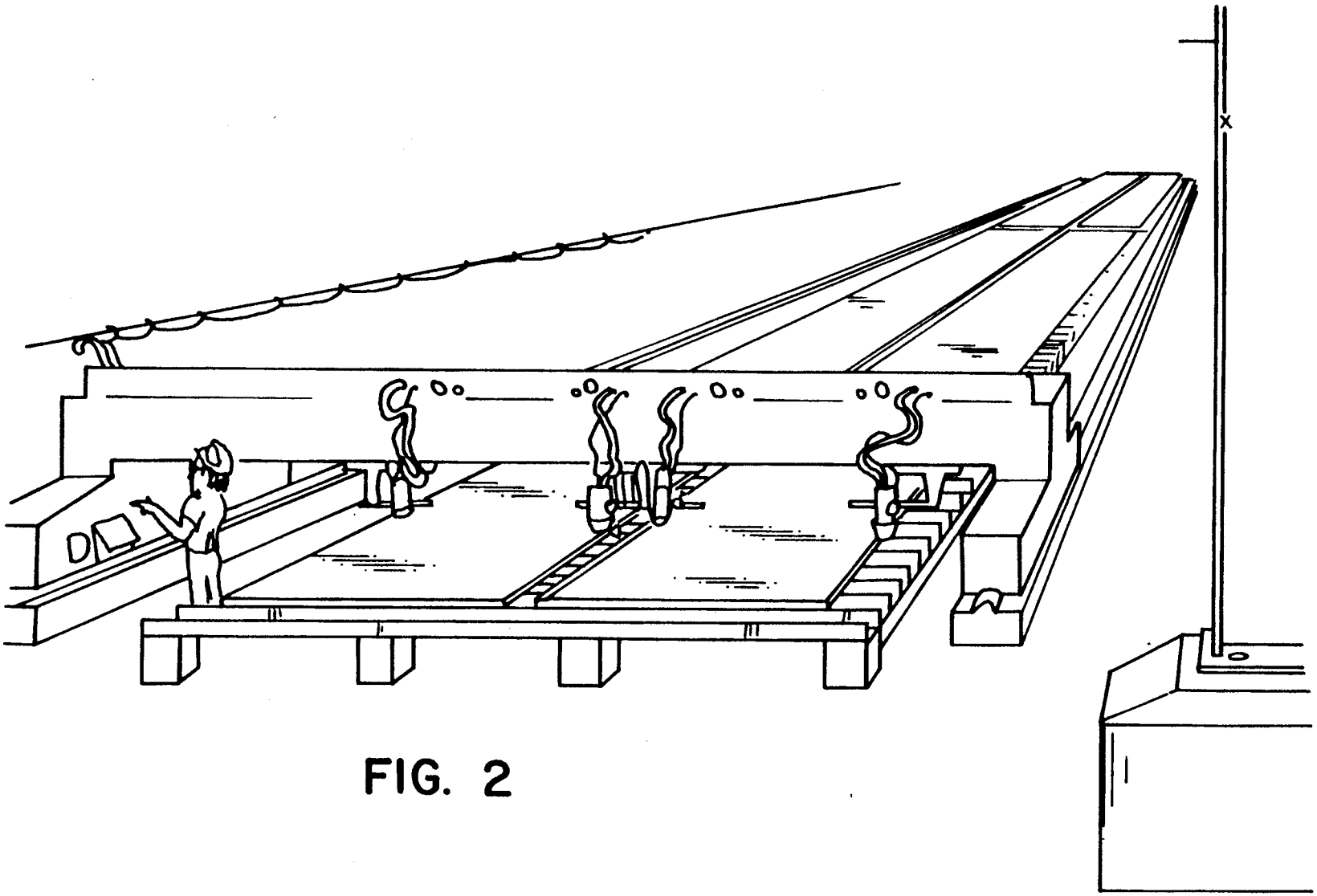
FIG. 2 is a pictorial view of a flame planer of the production line shown in FIG. 1.

First, plates 14 are cut to desired final dimensions using conventional flame planers 34 (FIGS. 1 and 2).

Figure 3:
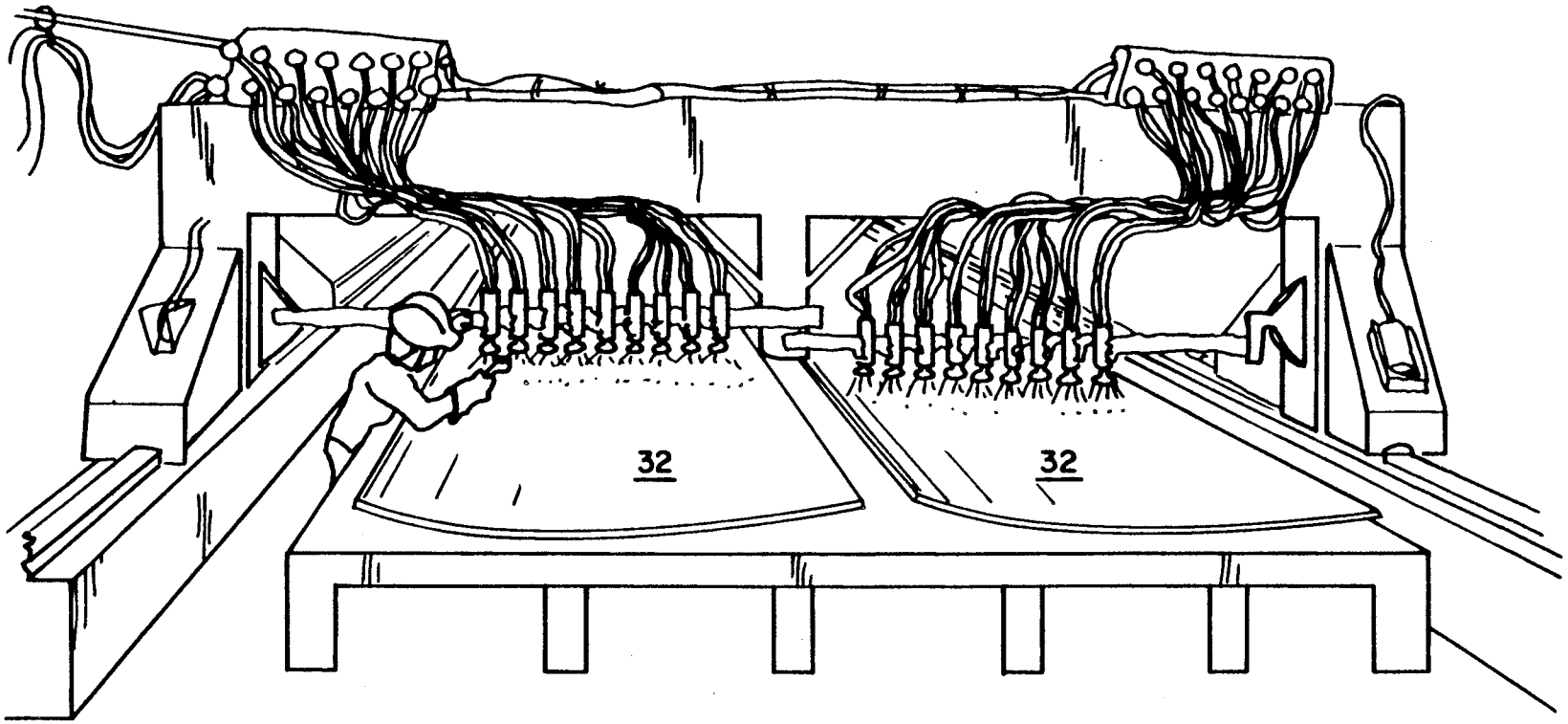
FIG. 3 is a pictorial view of a flame bender of the production line shown in FIG. 1.

Next, the trimmed plates are formed into panels 32 having the desired curvature using a conventional flame benders 36 (FIGS. 1 and 3).

Acceptable curved panels 32 are transferred to a painting station 38 (FIGS. 1 and 5) via conveyor 40 and trolley car 42.

Curved panels requiring further work are transferred to a repair station 44 by a trolley car 46 and, upon completion of repairs, transferred back into the normal curved panel production line and further processed as acceptable curved panels.

The line 28 processes about 10 percent of the incoming tonnage of plates 14 and produces kick plate stiffeners 48 for the flat longitudinal panels 66.

On the line 28, the plate is flame cut at 50 into strips of desired width (e.g., approximately 6 inches in width), and then sheared at 52 to the desired length and 45-degree end configuration. The completed kick plate stiffeners 48 are conveyed at 54 to an intermediate station on the flat panel production line 30.

On the line 30, plate 14 is cut at 56 to the desired final dimensions and configuration using an automatic burning machine (for cutting out lightening holes 58).

Figure 4:
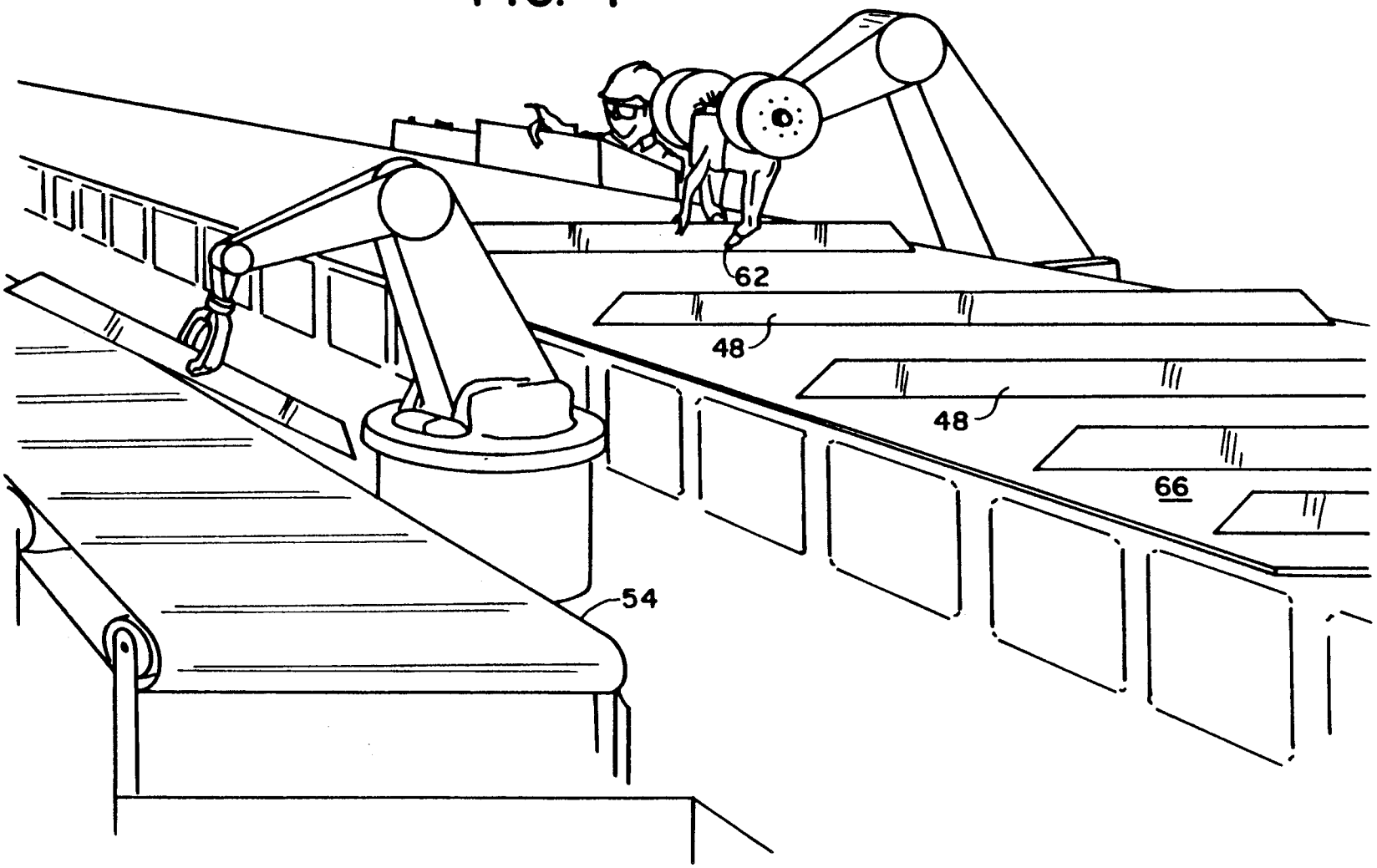
FIG. 4 is a pictorial view of a robotic installation and tack welding station for providing longitudinal panels with kick plate stiffeners on the production line shown in FIG. 1.

Kick plate stiffeners 48, including lightening hole reinforcements 60 are installed and tack welded robotically at 62 (FIGS. 1 and 4), then finish welded robotically at 64.

Figure 5:
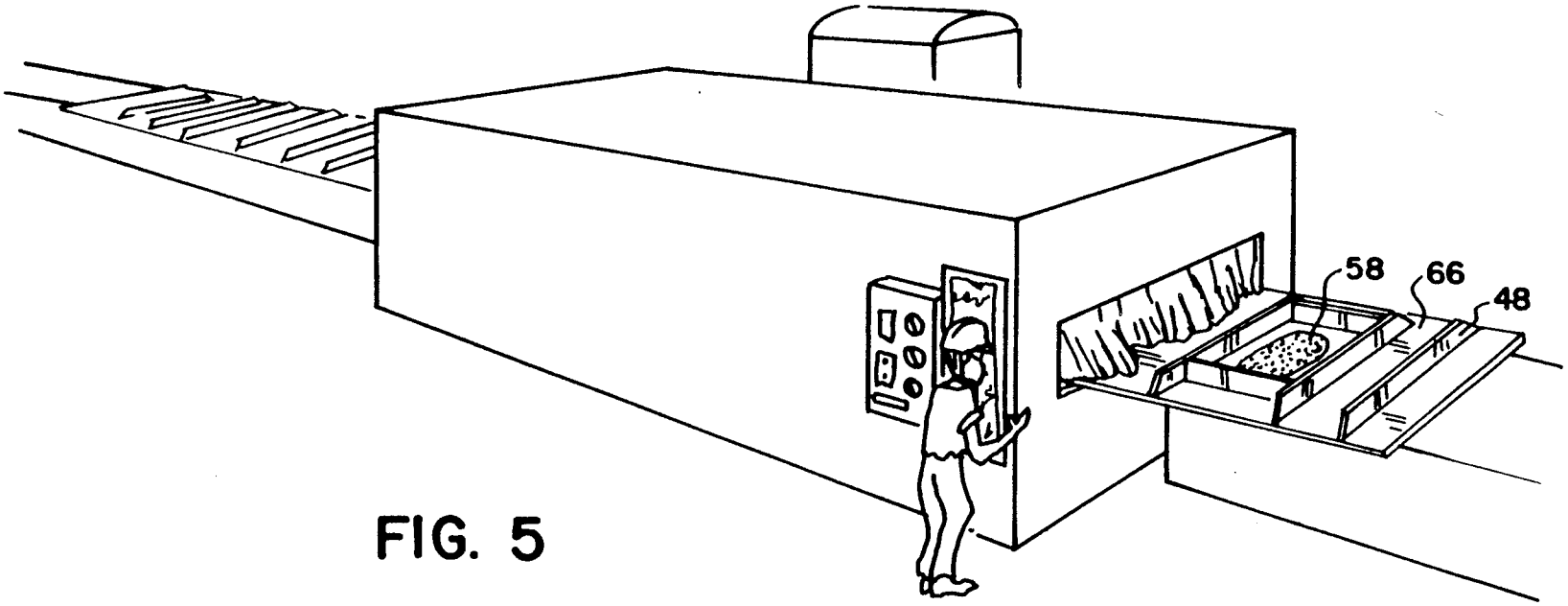
FIG. 5 is a pictorial view of a station for coating the tops and bottoms of panels with paint on the production line shown in FIG. 1.

Acceptable flat longitudinal panels 66, with their kick plate stiffeners 48 and lightening hole reinforcements 60 welded in place are run through a steel shot abrasive cabinet 68 where welded areas are spot-blasted (FIG. 5).

Flat longitudinal panels requiring repair are shuttled via trolley car to a repair area 70, repaired, and shuttled back to the touch-up blast cabinet 68 and thereafter forwarded as acceptable flat longitudinal panels.

At the painting station 38 (which may be one station serving both lines 26 and 30), the tops and bottoms of the curved and flat panels 32, 66 are coated with a first primer coat of paint, with several inches along each edge left unpainted to facilitate future welding. (The specific coating applied at this stage depends on whether the surface in question, in use, will face cargo, ballast, the external environment underwater or freeboard, or main deck service.)

Figure 6:
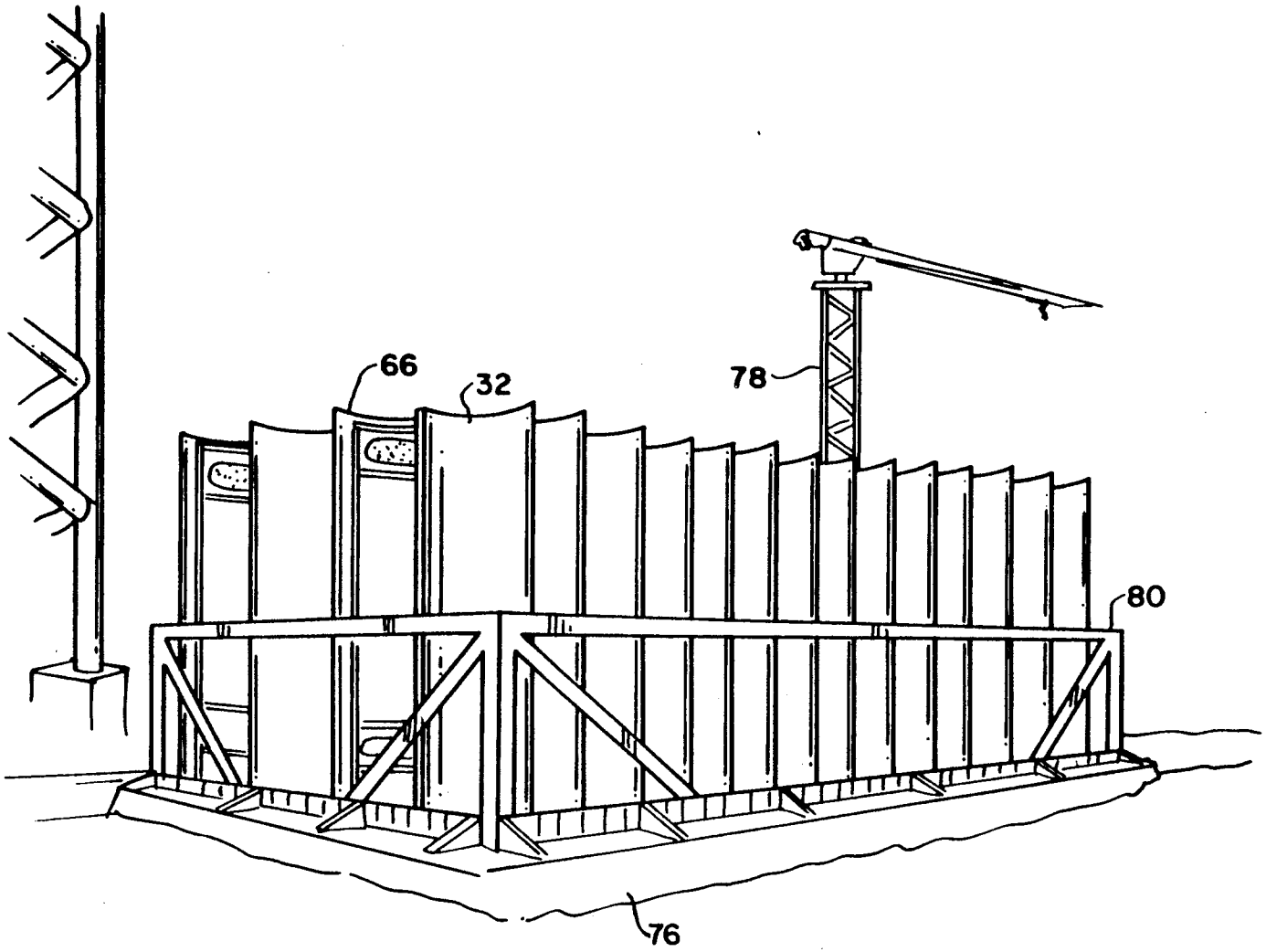
FIG. 6 is a pictorial view of a barge loaded with one module's complement of longitudinal panels as produced on the production line shown in FIG. 1, ready for movement to a subassembly area.

The painted curved and flat longitudinal panels are transferred to the pier 72 by means of a chain conveyor 74 and loaded aboard a barge 76 using a crane 78 (FIG. 6). Each barge 76 is provided with rack means 80 which permit one module's worth (with a few spares), of curved panels 32 and flat panels 66 to be loaded aboard in vertical orientation.

A barge 76, when fully loaded with module panels 32, 66, is moved to the module subassembly area (FIG. 7) so as to be located alongside the primary longitudinal subassembly fixture 82. At this site, the vertical longitudinal panels 32 and 66 are lifted from the barge 76 using a crane 84 and inserted vertically into respective slots 86 in the fixture 82. After all of the panels 32, 66 which are needed for constituting one longitudinal subassembly are located in the respective slots 86, hydraulic jacks 88 confronting each panel from each side and having respectively shaped contact pads 90 are energized for properly conforming and positioning each panel so that its edges 92 are juxtaposed with those of two others at a "T" (except at subassembly ends, where two panel edges meet at an "L").

Jacking elements of the individual interior towers 94 and exterior towers 96 (FIGS. 7–12) of the longitudinal subassembly fixture may be removed for repair, routine maintenance and adjustment to different dimensions and configurations, as needed.

Each tower 94, 96 is somewhat taller than the distance between bulkheads in the parallel midbody of the double-walled vessel hull that is to be built using the apparatus and process of the present invention (e.g., somewhat in excess of 50 feet tall).

Each tower 94, 96 may be constructed by driving into the ground four to six pilings (not shown) made of steel or reinforced concrete. Steel frames (i.e., pads) 90 are aligned and mounted to each tower at regular intervals (e.g., of 2∝4 feet) along the height of each tower.

The towers 94, 96 are of two different functional types. Exterior towers 96 are of a "C"-type; each is active in the +X or −X direction, depending on whether it confronts an interior tower 94 from one side or the other. Interior towers 94 are of a B-type which is active in +X, −X, +Y and −Y directions. On the interior towers, the pads 90 face in the +X, −X, +Y and −Y directions (except at the two ends of the fixture, where two B-type towers are externally provided, one active only in the +Y direction and the other active only in the −Y direction). On interior towers 94 the Y-facing steel frames 90 are mounted to the towers via horizontally extensible-retractile hydraulic rams 88.

In use, when the fixture 82 is empty, all rams 88 for the steel frames of all towers 94 and 96 are retracted, allowing the various curved panels 32 and flat panels 66 to be lowered into place. As the rams 88 are then extended, the curved plates are jacked by steel frames on the exterior towers against the reactive steel frames jacked against the interior towers, and the flat plates are jacked by the steel frames on the interior towers against the reactive steel frames jacked against adjacent interior towers. Water cooled welding backing shoes 90A capable of being retracted and extended are installed at each corner of each interior tower 94.

Figure 12:
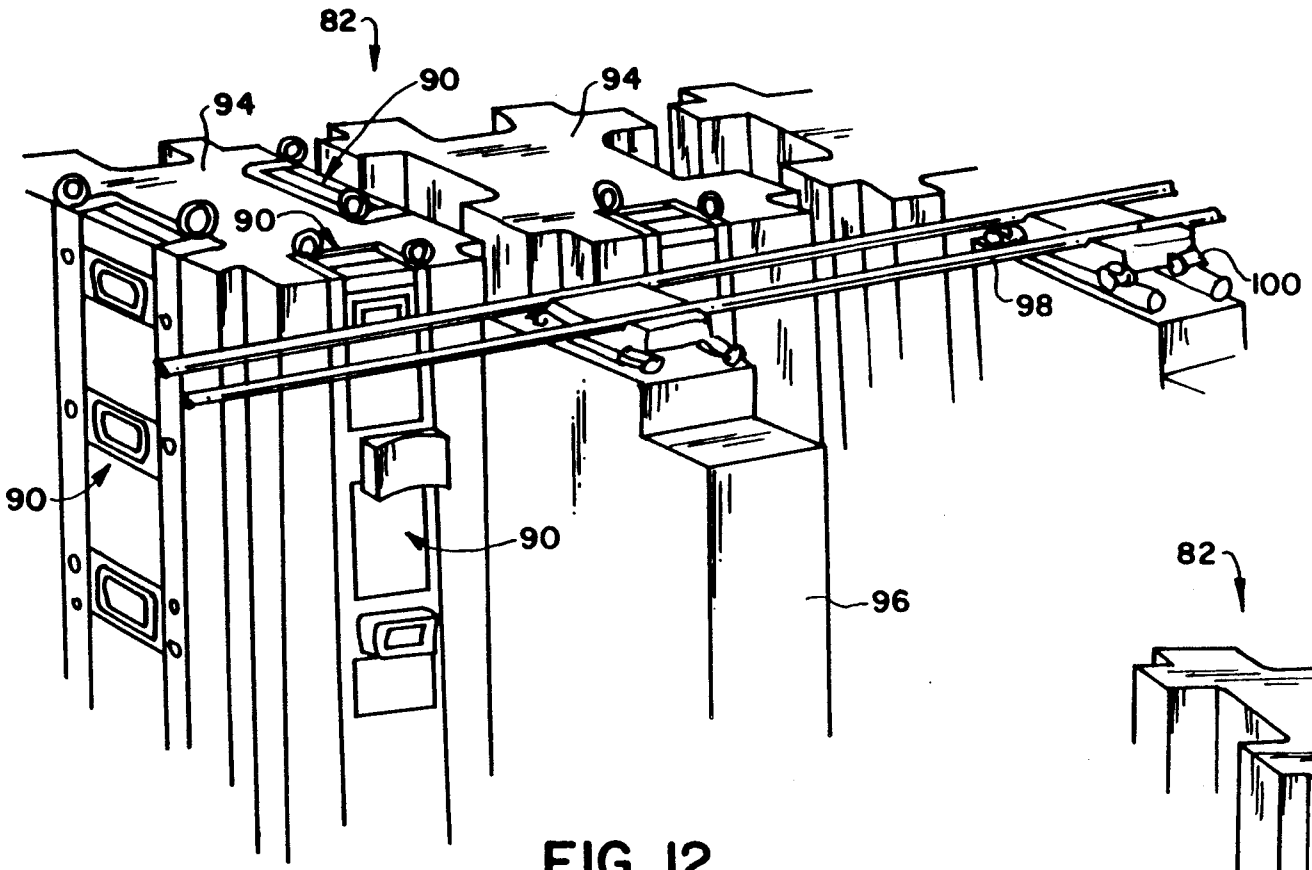
FIG. 12 is a fragmentary pictorial view of the top of the longitudinal subassembly fixture showing bar supports on rollers at the tops of individual outside towers thereof.
Figure 14:
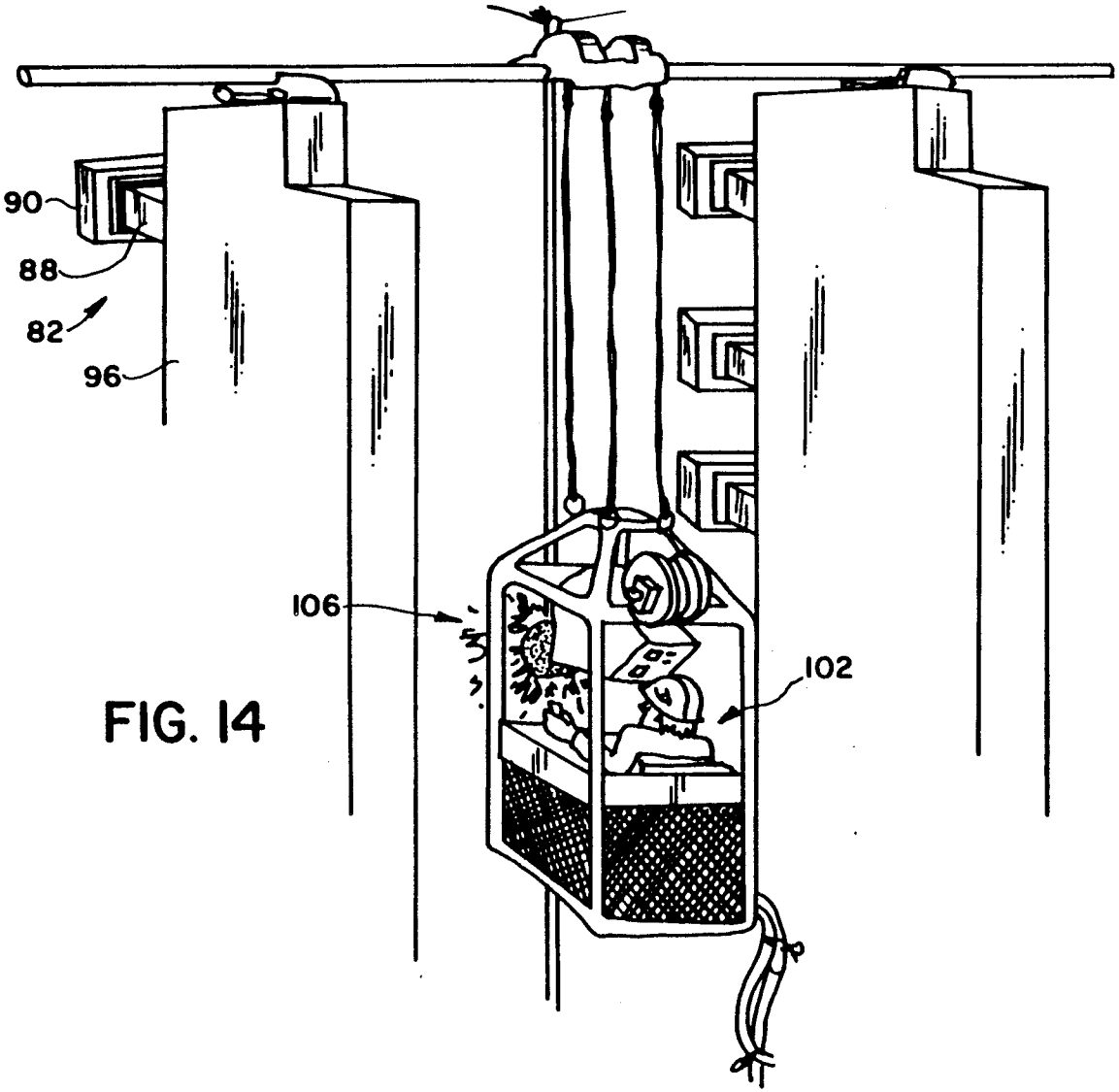
FIG. 14 is a pictorial view showing the apparatus of FIG. 13 being used to create a welded T-joint at the intersection of two hull plates and a longitudinal stiffener plate.

Bar supports 98 on rollers 100 are located at the top of the individual outside towers 96 of the longitudinal subassembly fixture 82 (FIG. 12). The purpose of the bar supports 98 is to provide an adjustable support location for a hanging basket-type staging device 102 (FIG. 14) at each T-joint intersection 104 of individual longitudinal panels. This hanging basket is utilized for electroslag or electrogas welding equipment 106 and an operator, including equipment for cleaning steel about to be welded (FIG. 14). Welding of all of the T-joints of one longitudinal subassembly unit 108 is done simultaneously to avoid distortion.

Figure 7:
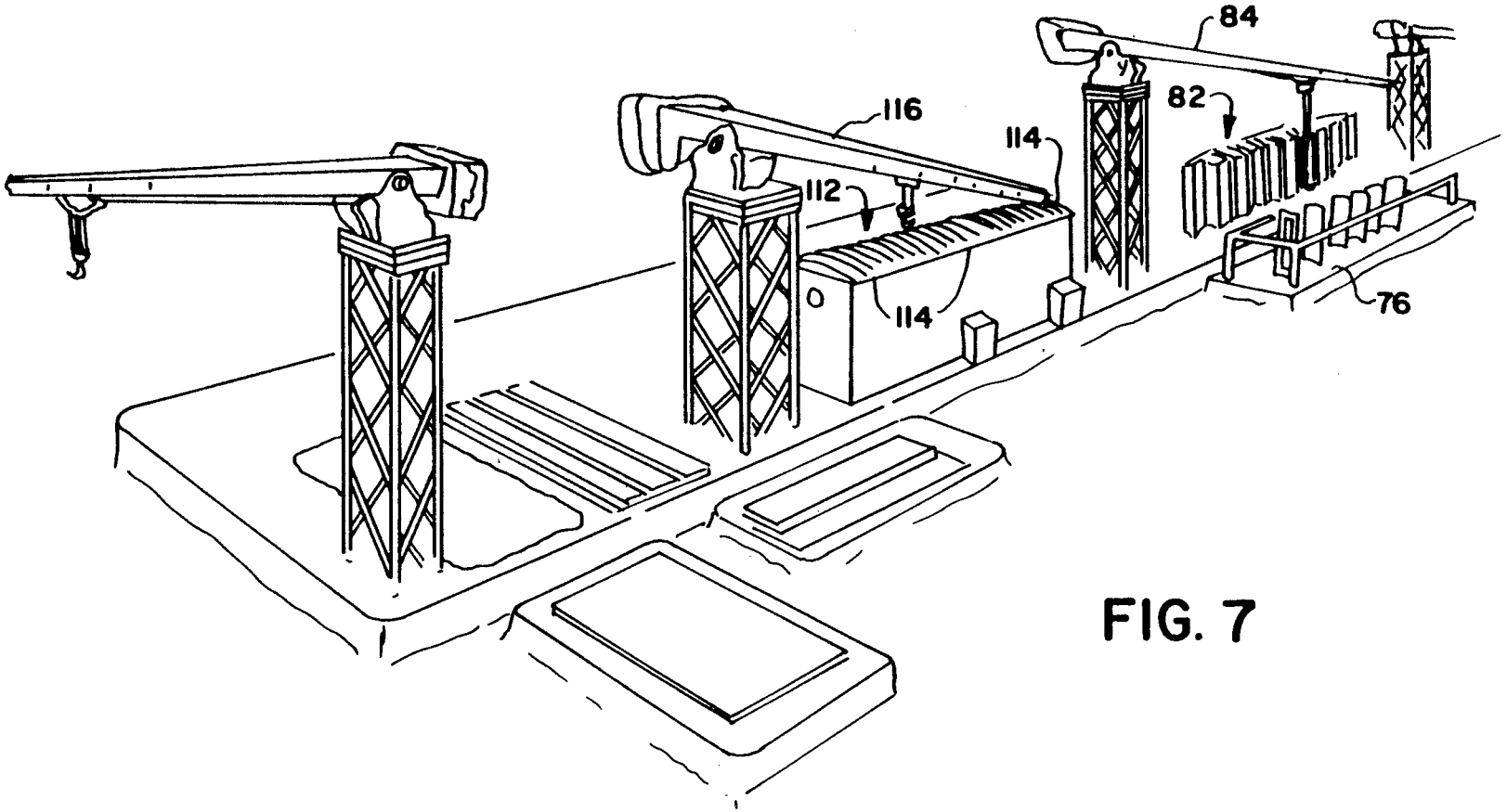
FIG. 7 is a pictorial view of a module subassembly area.
Figure 8:
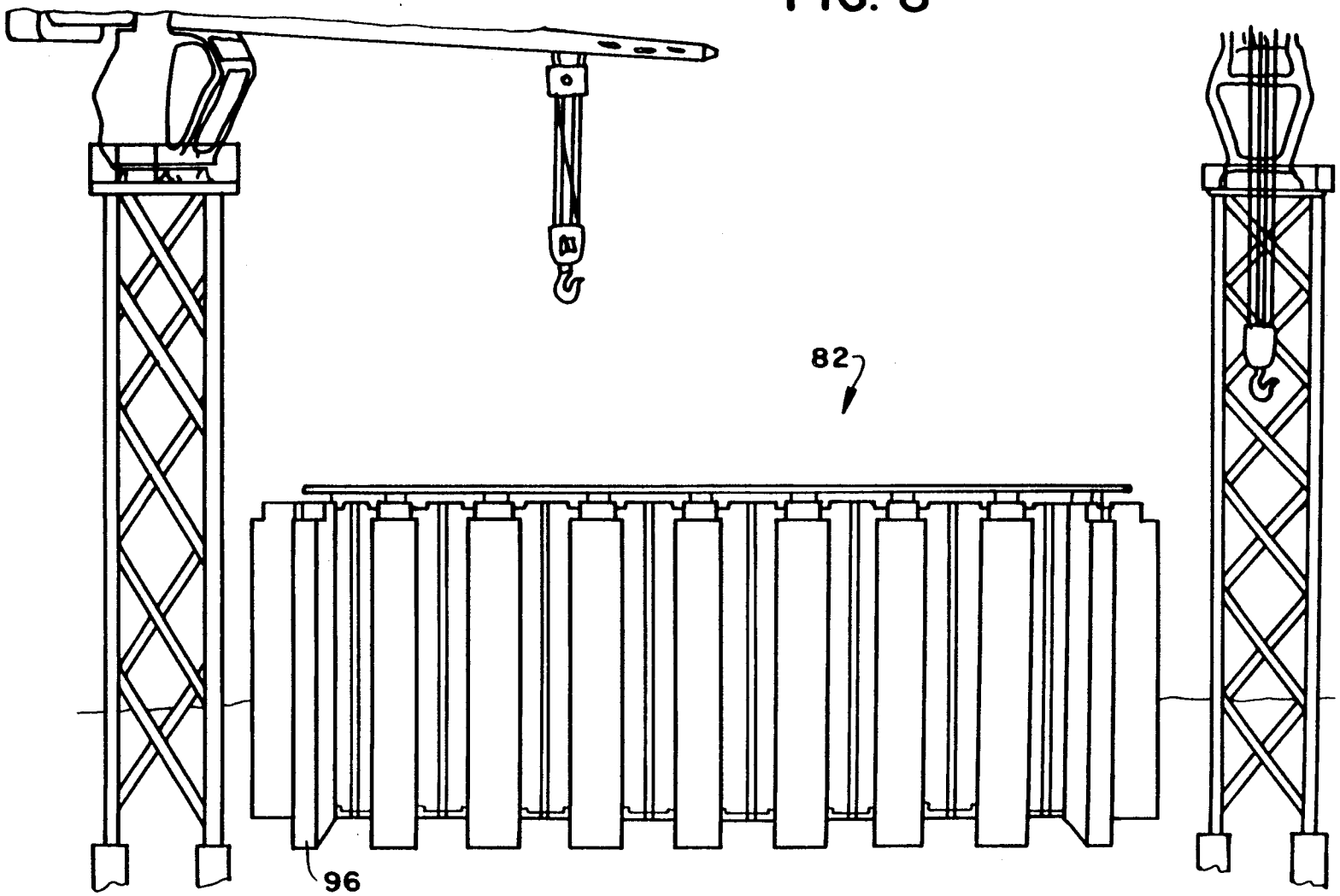
FIG. 8 is a pictorial view of a longitudinal subassembly fixture at the longitudinal subassembly area shown in FIG. 7.
Figure 9:
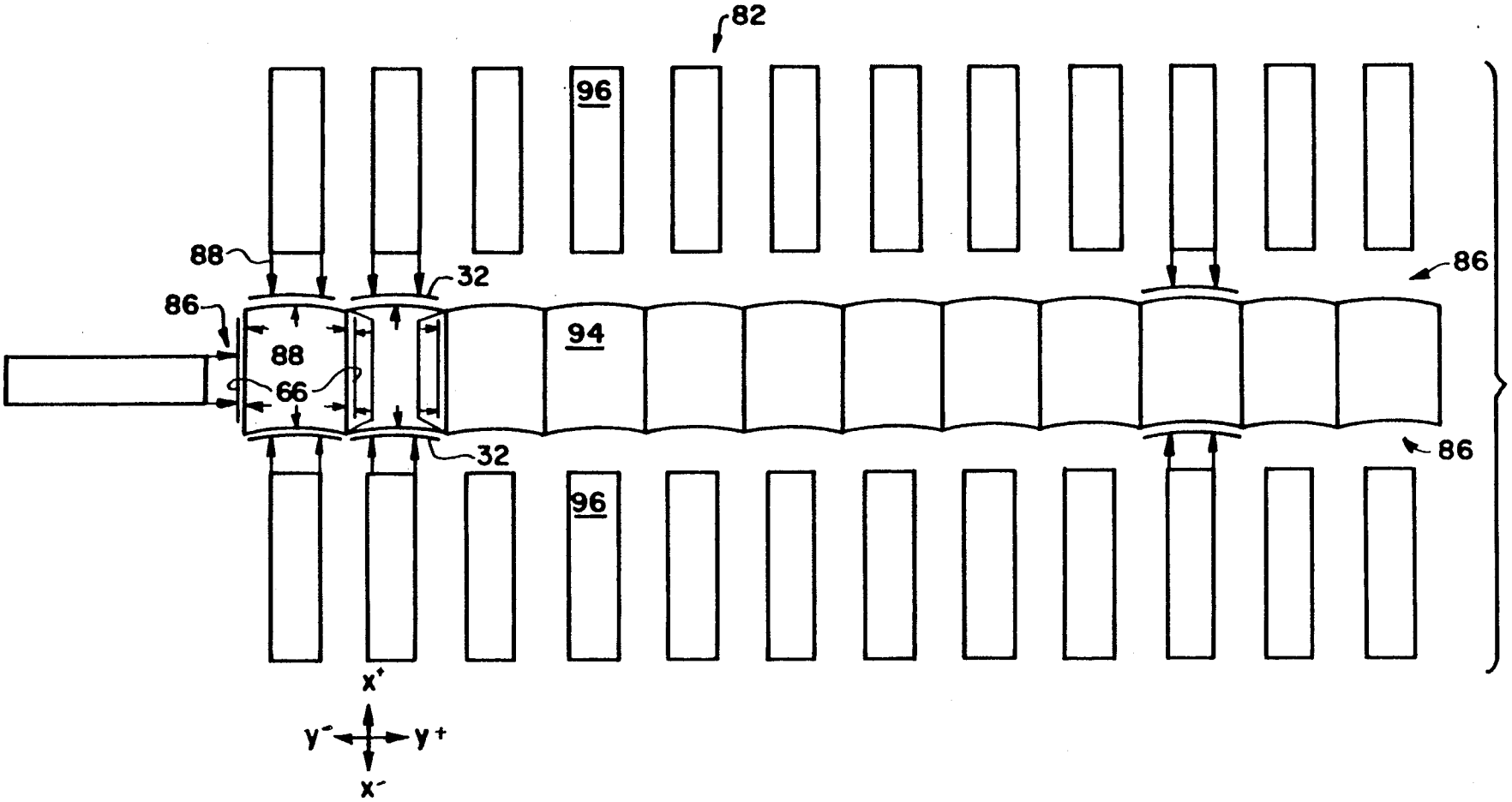
FIG. 9 is a top-plan view of the longitudinal subassembly fixture.
Figure 11:
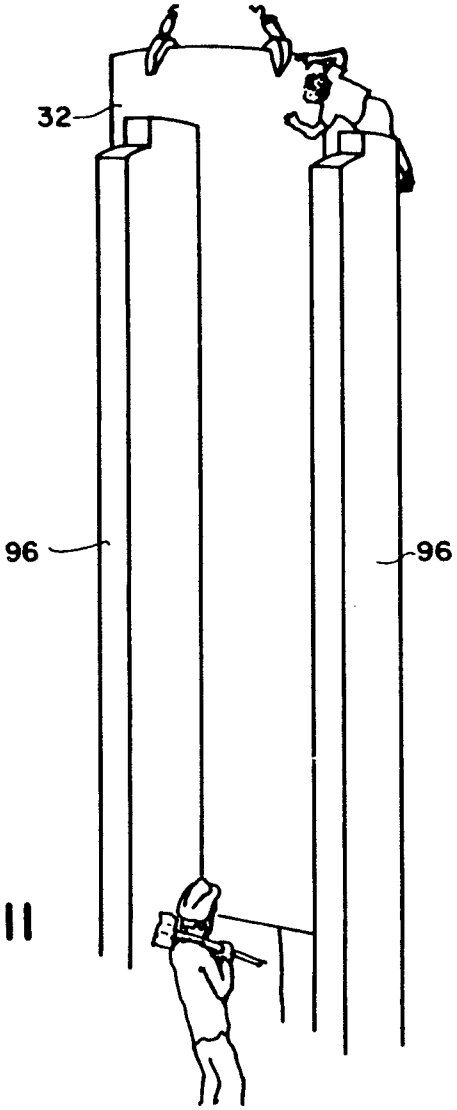
FIG. 11 is a pictorial view showing workers installing a panel in the fixture of FIGS. 8–10.
Figure 10:
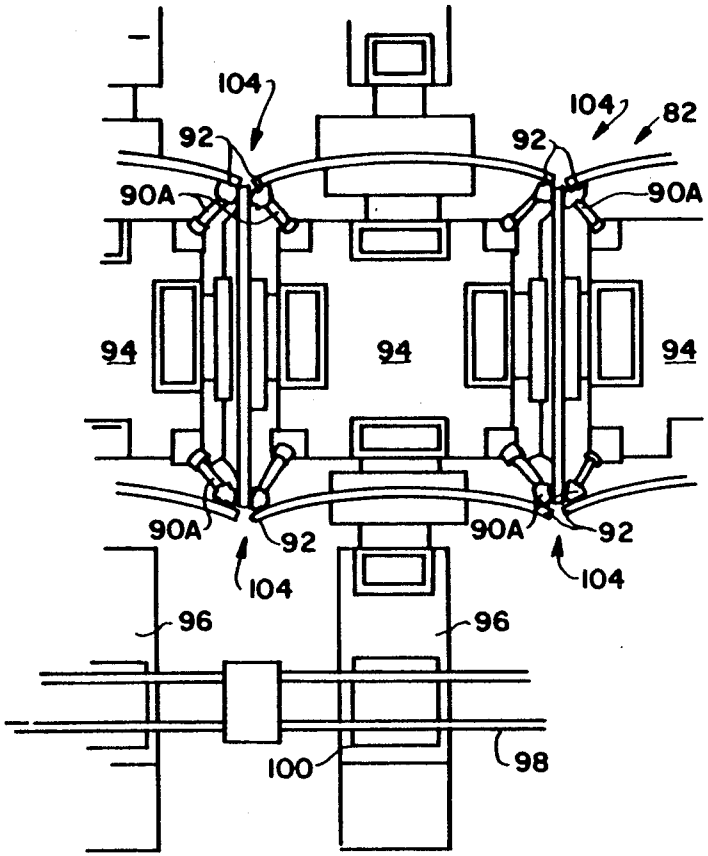
FIG. 10 is a larger scale fragmentary top-plan view of the longitudinal subassembly fixture.
Figure 15:
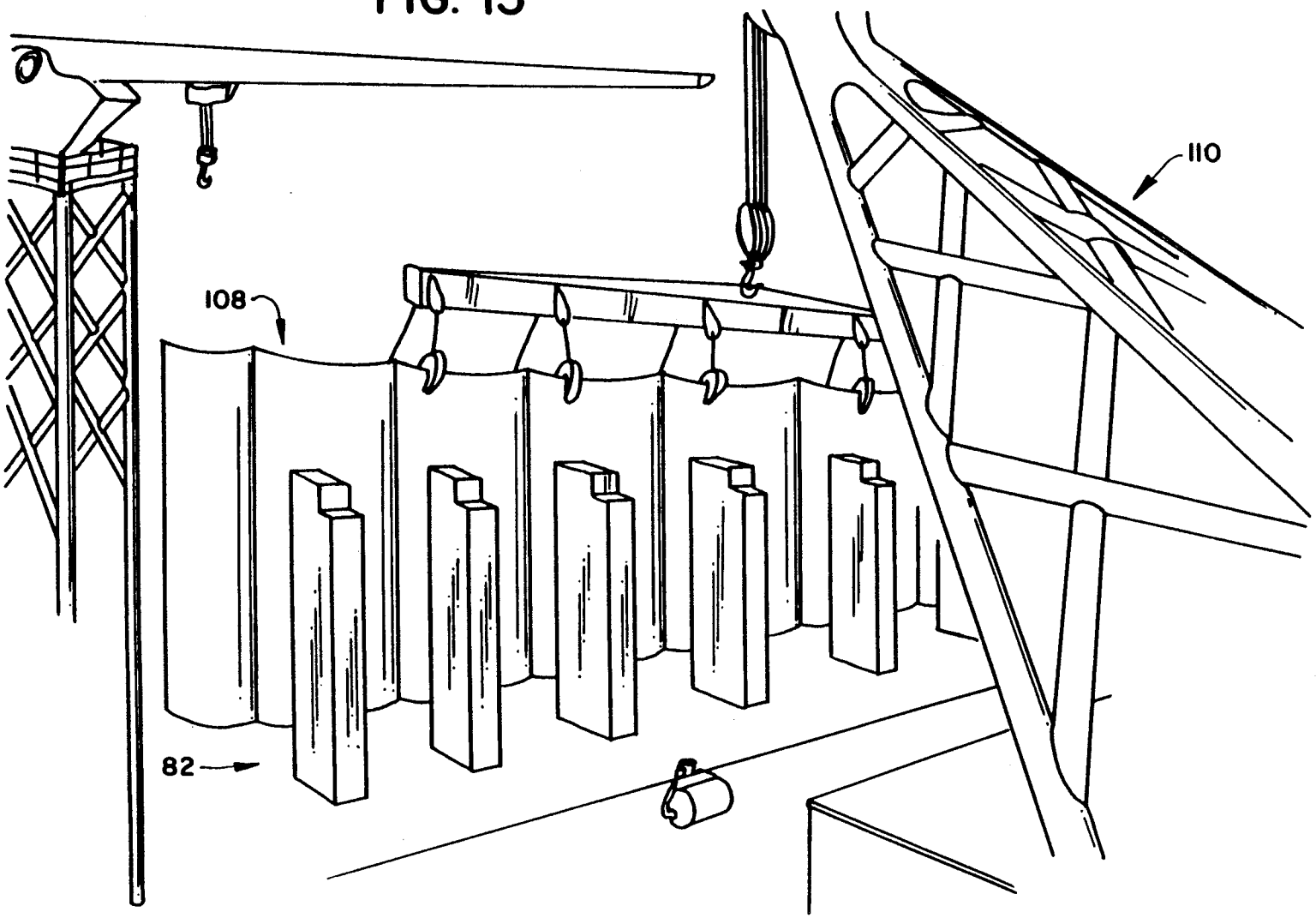
FIG. 15 is a pictorial view showing the longitudinal subassembly fixture after welding of the panels into a hull midbody module has been completed and the hydraulic jacks have been released, allowing a floating derrick to remove the module to a touch-up, blast and final paint room of the subassembly area shown in FIG. 7.

Upon completion of welding, the hydraulic jacks 88 are released, and the longitudinal subassembly unit 108 is lifted from the longitudinal subassembly fixture 82 (FIG. 15) utilizing a floating derrick 110 of sufficient capacity (350 tons or greater) and moved to the longitudinal assembly touch-up, blast, and final paint room 112 (FIG. 7).

Figure 13:
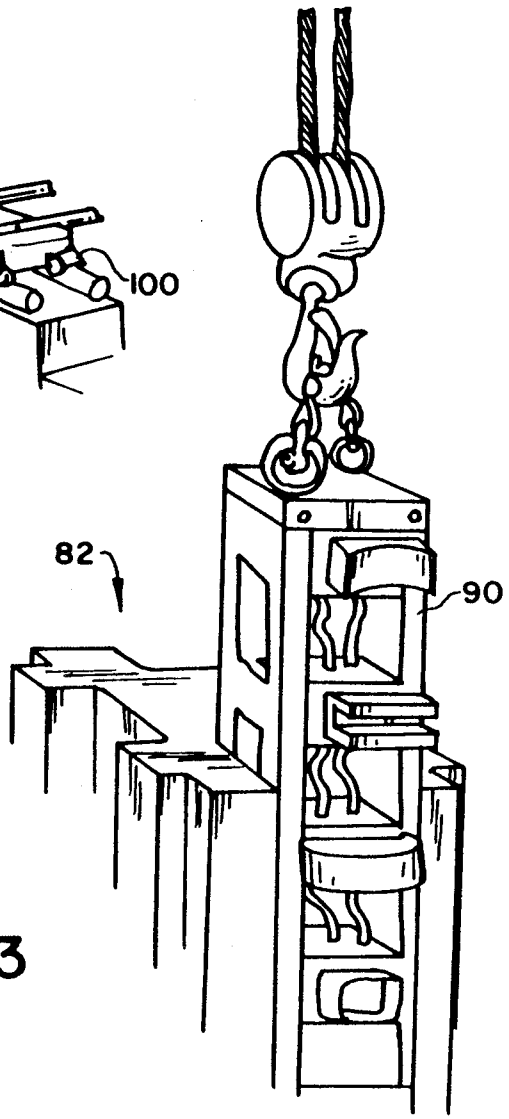
FIG. 13 is a pictorial view similar to FIG. 12 showing the hanging basket-type staging device used at each T-joint intersection of longitudinal panels for cleaning and welding of the joints.

(The time required to process a single longitudinal assembly through the longitudinal subassembly fixture is 24 hours. This includes 8 hours for lifting all individual longitudinal panels off the barge and setting them into final position, 8 hours for electroslag or electrogas welding of all T-joints and 8 hours for maintenance of the fixture, change-out of individual jacking elements (FIG. 13), if required, and any other preparation of the fixture to receive the longitudinal panels for the next longitudinal subassembly.)

The longitudinal subassembly touch-up blast and final paint facility 112 (FIG. 7) is a building approximately 100 feet long, 20 feet wide and 60 feet high. The roof 114 is removable in sections to permit longitudinal subassemblies 108 to be top-loaded into it. The floor (not shown) of the room 112 is a grating under which recovery and recycling apparatus for abrasive material used for abrasive blasting is located. The floor is reinforced as necessary to support the weight of a longitudinal subassembly 108. A canvas cover is placed over the grating when abrasive blasting is completed and painting commences.

In the room 112, stationary or fixed elevator towers (not shown) equipped with shot-blasting and spray-painting nozzles are located in positions in the building which center them in individual longitudinal cells of the longitudinal subassembly. These elevators are used for automatic shot-blasting and painting of inside surfaces of the longitudinal subassemblies. Further, elevators (not shown) are permanently located along the walls of the building to permit automatic shot blasting and painting of outside surfaces of longitudinal subassemblies. Shot-blasting nozzles inside and outside the cells are located only in way of welded T-joints. Paint spray nozzles inside and outside the cubicles provide full surface coverage. Dust collection equipment (not shown) is provided to remove dust caused by shot blasting. Heating, ventilation and dehumidification equipment (not shown) is provided to control the environment and assure that release of solvents and dust to the atmosphere externally of the building 112 is within clean air standards. All electrical installations are explosion-proof.

Reiterating in sequence the steps carried out in the room 112, the roof sections 114 are removed, a longitudinal subassembly 108 is lowered in a vertical position into the longitudinal assembly touch-up, blast, and final paint facility using the 350-ton floating crane device 110. Shot blast and spray paint nozzles are adjusted as required for the particular longitudinal subassembly. Roof sections 114 are put in place using a tower crane 116.

T-joint welded areas are shot-blasted automatically, as the elevator carriages with the blast nozzles travel the full height of the longitudinal subassembly.

Grating covers are installed on the floor in order to keep paint away from abrasive recovery mechanisms. Structure in way of future bulkhead welding and module joining welding is masked off. All surfaces are then painted with the appropriate paint systems, as the elevator carriages with the paint spray nozzles travel the full height of the longitudinal subassembly. Subsequent coats of paint are applied at appropriate intervals until final paint systems on all surfaces are complete.

Figure 16:
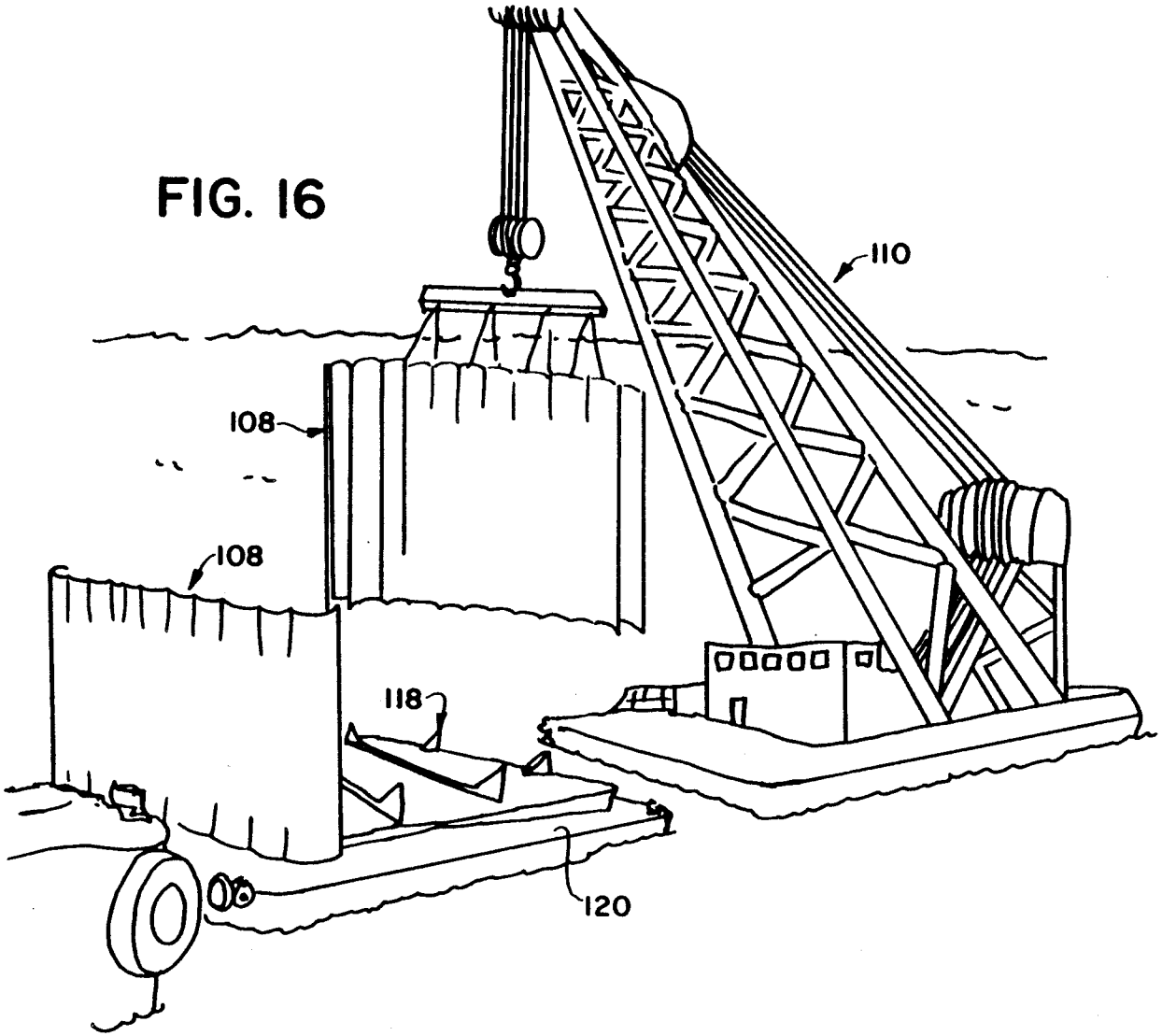
FIG. 16 is a pictorial view of a module assembly pontoon fixture with a bulkhead subassembly already positioned thereon, and individual fully painted hull midbody modules being placed thereon by a floating derrick.
Figure 17:
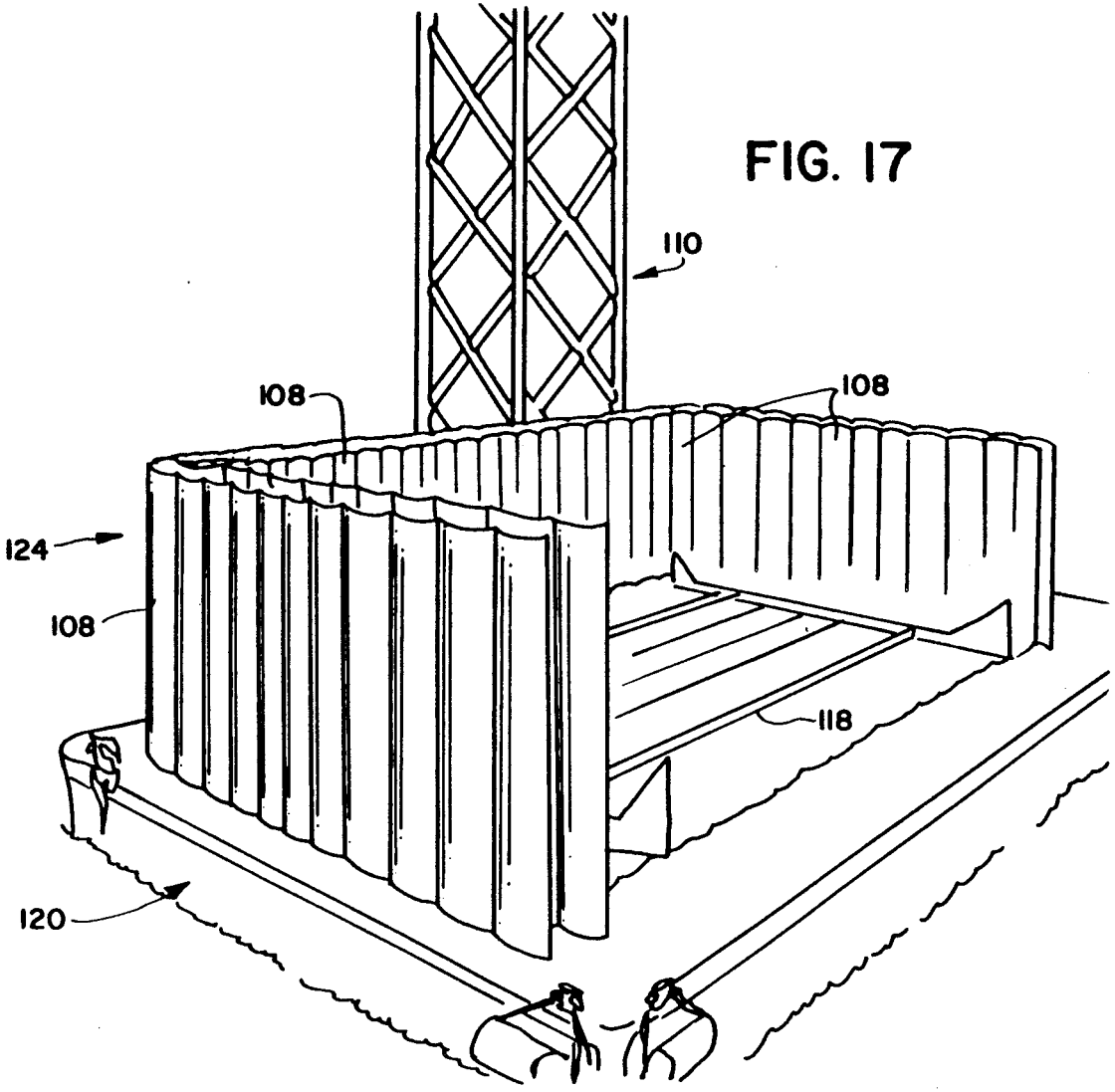
FIG. 17 is another pictorial view of the apparatus shown in FIG. 16, from a different perspective, after another hull module has been put in place on the bulkhead assembly on the module assembly pontoon fixture.

The roof 114 sections are removed by the tower crane 116, and the fully painted longitudinal subassembly 108 is lifted from the longitudinal assembly shot-blast and paint facility 112 using the 350-ton floating derrick 110 and placed in a respective position around a bulkhead subassembly 118, previously positioned on a module assembly pontoon fixture 120 (FIGS. 16 and 17).

The bulkhead assembly 118 interior to the inner hull may be placed on the module assembly pontoon 120 either by a floating derrick, or by rolling the finished bulkhead from its assembly position adjacent to the module assembly pontoon location.

The module assembly pontoon 120 is approximately 200 feet long, 100 feet wide and 10 feet in depth. It is capable of changing its buoyancy by pumping water into, or out of its tanks (not shown). While bulkhead longitudinal subassemblies 108 are being set in place, it rests on an underwater pile-supported grid 122 (FIG. 19) to provide stability. In order to permit access by the 350-ton floating derrick 110 to all longitudinal subassembly module assembly locations on the pontoon 120, the module assembly pontoon 120 may be rotated after pumping water out of its tanks and increasing its buoyancy adequate to lift it off the grid 122, and then pumping water back into its tanks after rotation to the desired position so that it again rests on the grid as the next subassembly 108 is emplaced.

The purpose of having a piling supported grid under the pontoon is to enable the pontoon to have more time to respond to sudden load changes, i.e., the setting of a 300-ton longitudinal subassembly near the edge of the pontoon. However, the grid need not be designed to take the full weight of the pontoon and its contents, since the pontoon's own buoyancy can support most of the weight. The grid need only support that load weight which the pontoon cannot quickly respond to and, for convenience, the buoyancy lost by the pontoon when sitting on the grid at normal high high tide as the tide goes to low low. There is usually sufficient warning time to ballast down the pontoon so it does not float off on extraordinary high tides.

The piling under a pontoon grid, therefore, only has to support a portion of the load, invariably less than half. (In fact, floating pontoon dry docks do not use grids at all, relying totally on buoyancy. Graving dock floors and piling, which must support the full load are, therefore, much more expensive to construct than grids.)

The deck of the module assembly pontoon fixture has precisely located guides welded to it. As each subassembly is lowered in place, the bottom of the flat and curved panels of the subassembly are forced into the precise position dictated by the guides.

The top end of the subassembly is adjusted until optical alignment determines it is perfectly vertical. This adjustment is accomplished by existing techniques of using turn buckles and "come alongs" attached to the subassembly at one end and the bulkhead, pontoon or adjacent subassembly at the other end. When all subassemblies are set in this manner, all vertical joints are ready for welding.

After all the longitudinal subassemblies 108 for one module are in place around the bulkhead subassembly 118 on the module assembly pontoon 120, finally fit in place and temporarily secured, downhand welding of the longitudinal subassemblies to the perimeter of the bulkhead subassembly is carried out.

Vertical elevator assemblies (not shown, but similar to the one shown in FIG. 14) containing electroslag-/electrogas welding machines (and, optionally, blasting and painting apparatus) are put in place at all external and cargo tank interior locations where there are vertical module assembly joints to weld. All vertical module assembly joints are welded concurrently to minimize distortion using the electroslag/electrogas process.

Bulkhead structure within the ballast 108, 118 tank area of the module 124 under construction is installed, fit and welded as the subassemblies are being put in place and welded. Piping assemblies (not shown) are also installed during this time. (Some final installation and pipe hanger welding may be done on piping located on the tank top or in ballast tanks after erection of the module and orientation into its final position.)

Areas disturbed by welding done during the module assembly stage are preferably blasted by the least disruptive, most efficient, and environmentally acceptable approach. This can be by Vacublast blasting or dry ice blasting. These blasted areas are then final painted either by spray gun, brush or roller depending upon impact on other ongoing work and impact on air quality.

A temporary bulkhead with a gasket (not shown) is installed across the inner bottom tanks (cells) at the top of the module 124 in its vertical, module assembly position. Temporary bulkheads (not shown) are also installed in each side tank cubicle (cell) attached to a kick bracket (plate) at least 2.5 feet from the top.

Figure 18A:
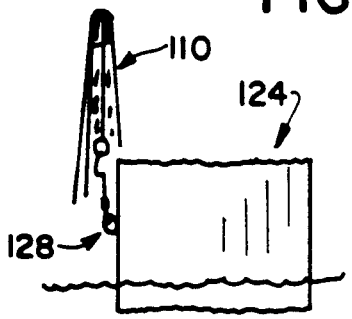
FIGS. 18A–18E are a series of five side-elevational views, partly in section, of erection (tilting over from a vertical orientation to a horizontal orientation of a hull midbody module, which is then floated towards a module joining facility for joining to previously positioned structure)
Figure 19:
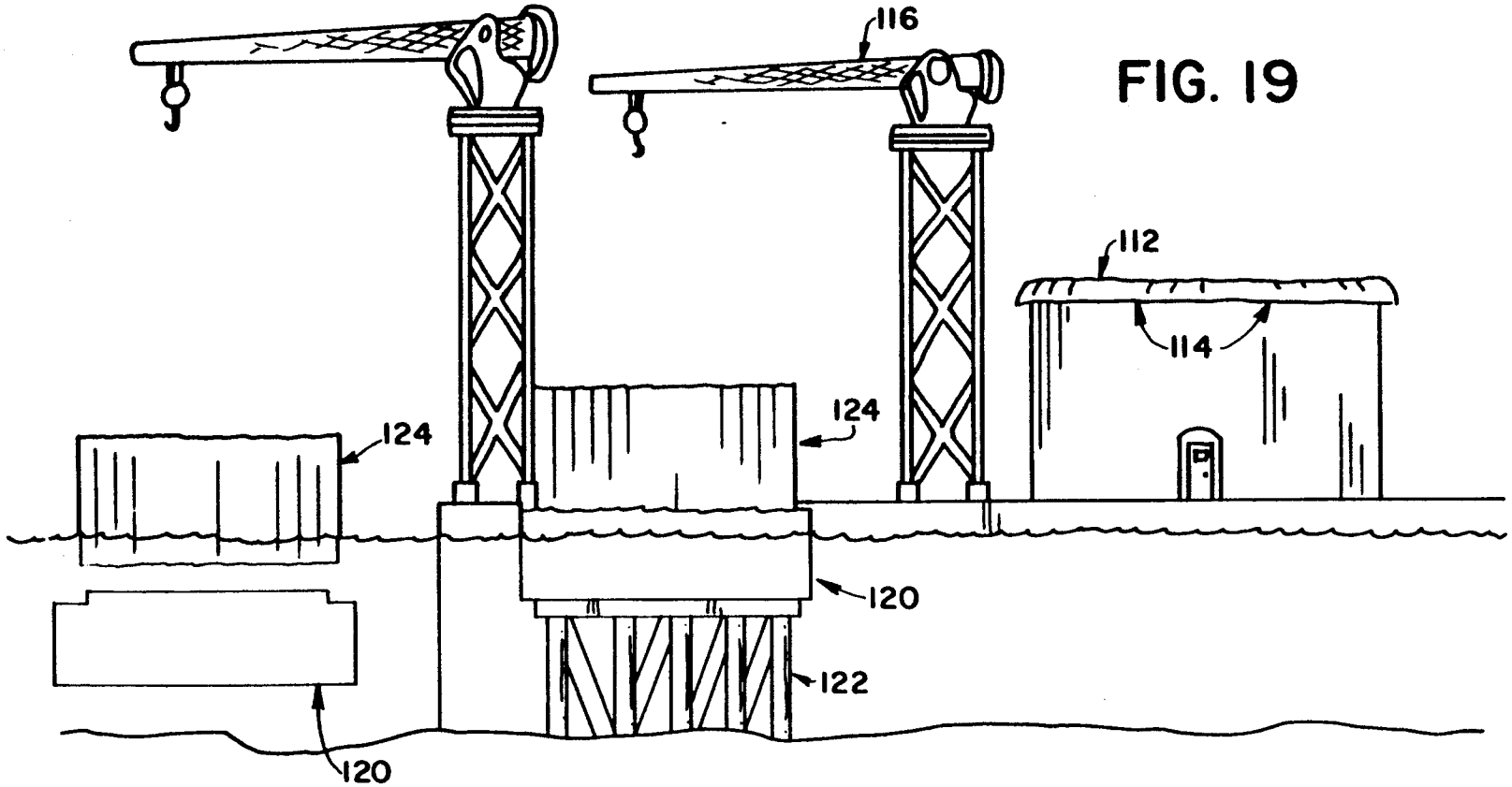
FIG. 19 is a side-elevation view of the module erection pontoon and supporting grid with separate view of sinking the module erection pontoon to float the module.

After completion of the above and any other work most efficiently performed in the vertical, module assembly position, the module assembly pontoon is floated off its supporting grid and sunk leaving the module afloat on its bulkhead, as indicated in FIG. 18A and the left side of FIG. 19.

Figure 18B:
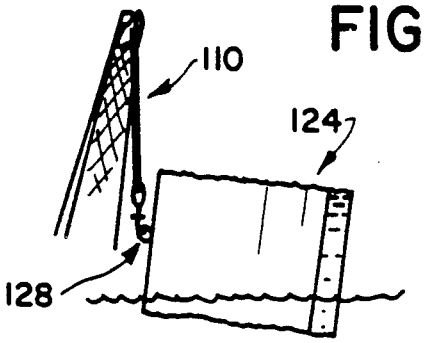
Figure 18C:
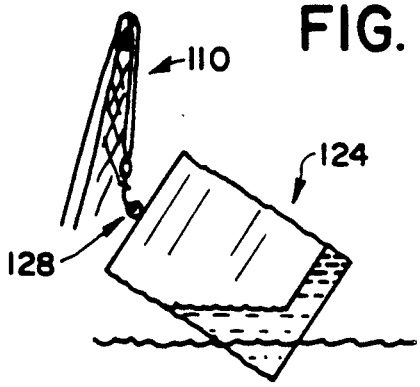
Figure 18D:
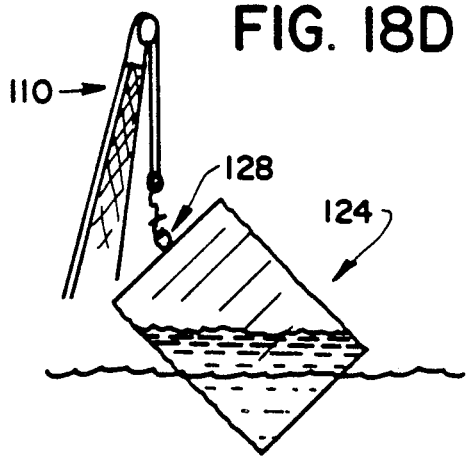
Figure 18E:
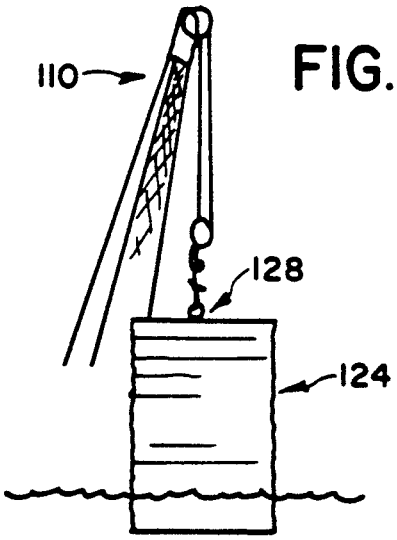
Figure 20:
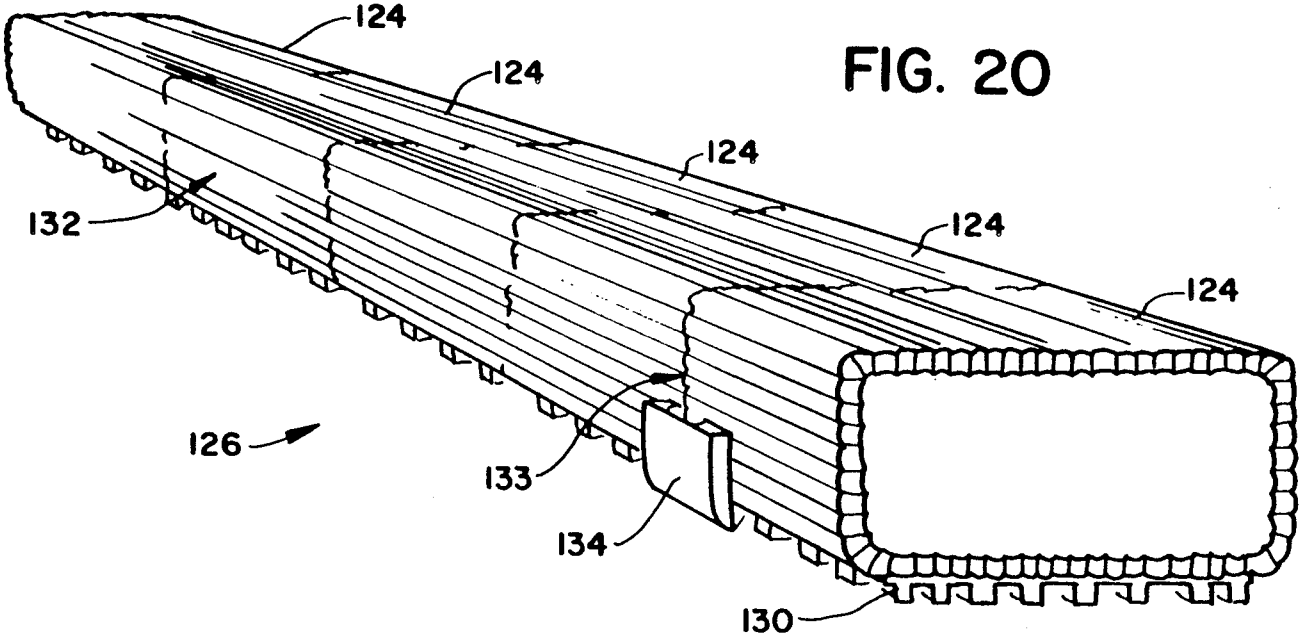
FIG. 20 is a pictorial view of the module joining facility, at a later stage than depicted in FIGS. 18 and 19, and with the water omitted so as to show the supporting structure and module-joining pontoon caisson.
Figure 21:
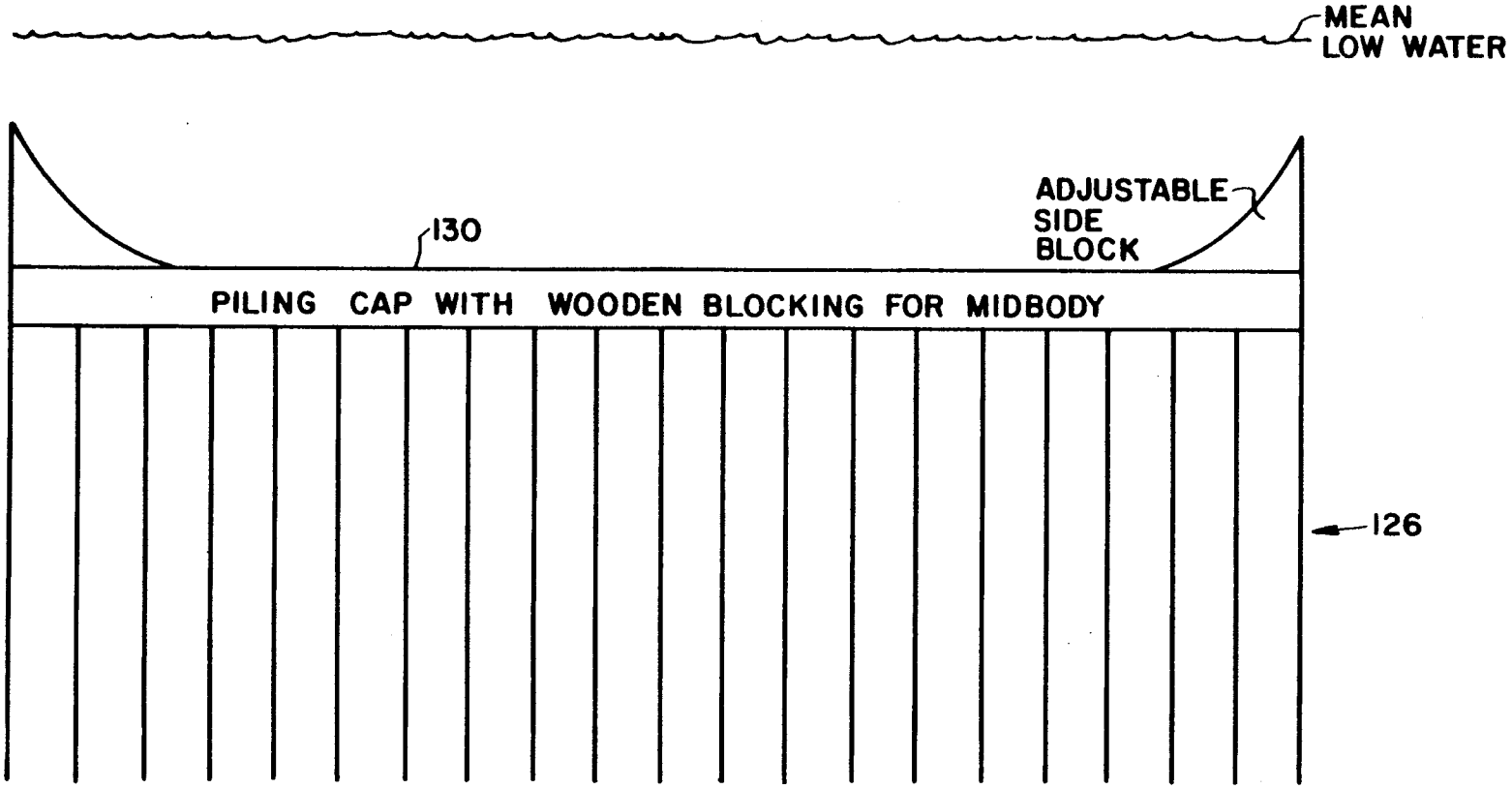
FIG. 21 is a transverse-sectional view of the module joining facility.
Figure 22:
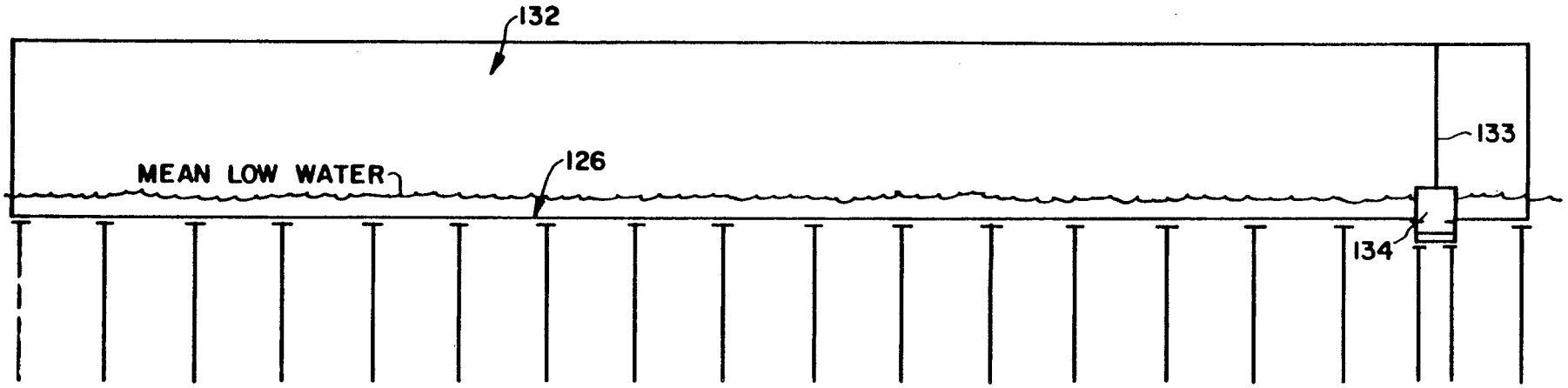
FIG. 22 is a side-elevational view of the module joining facility.
Figure 23:
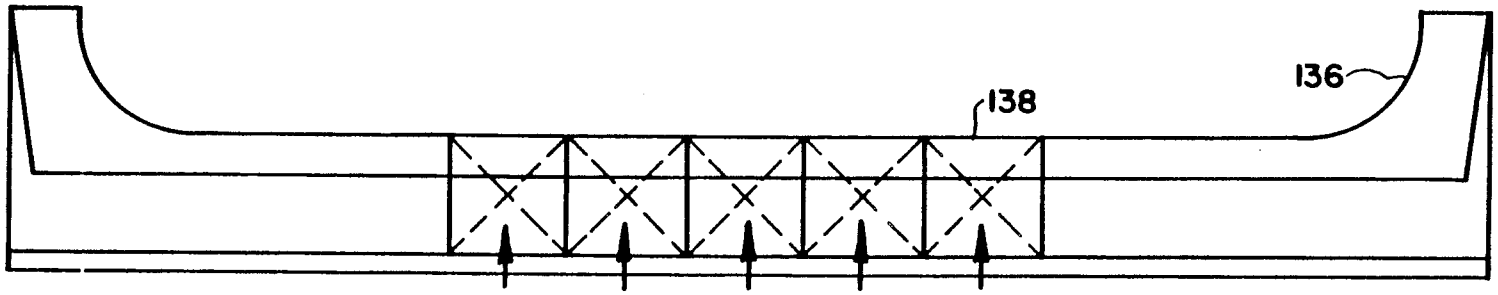
FIG. 23 is a transverse sectional view of the module joining facility at the location of the module joining pontoon caisson.
Figure 24:
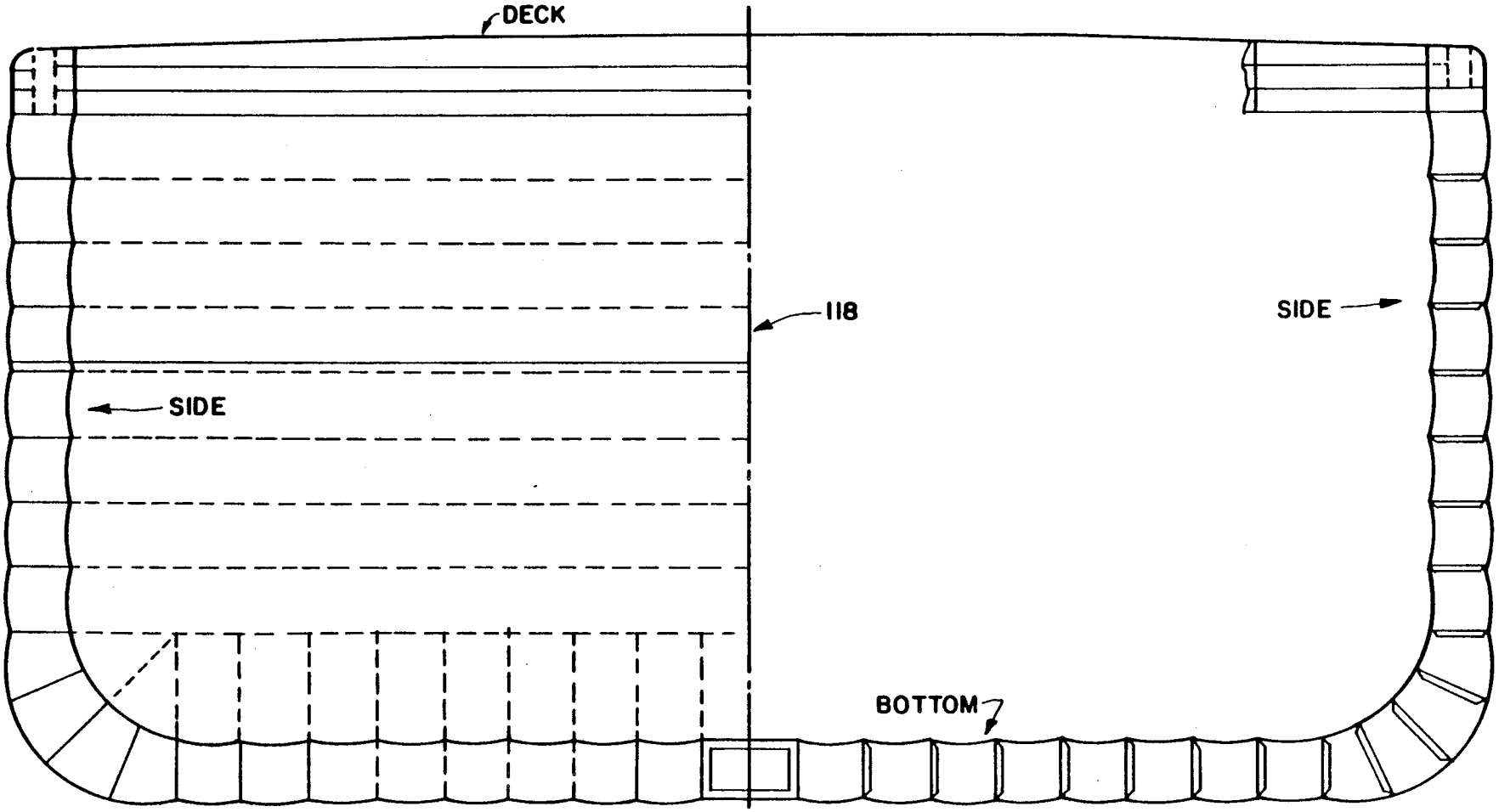
FIG. 24 is a transverse cross-sectional view of a double-hulled vessel, through the midbody thereof, constructed in accordance with principles of the present invention, a bulkhead being illustrated in the left half of the view.
Figure 26:
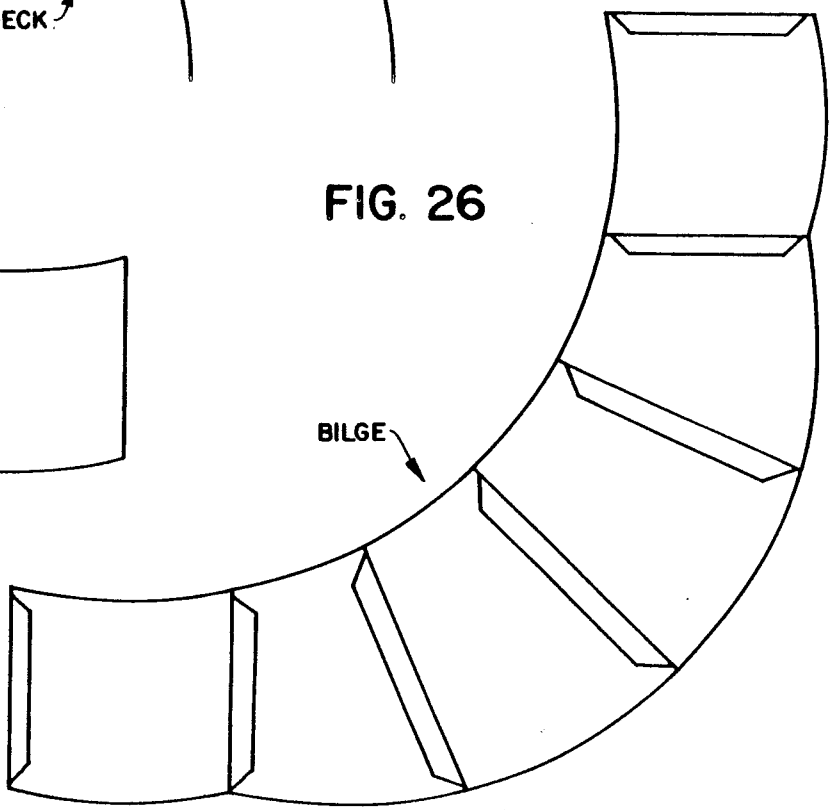
FIG. 26 is an enlarged scale fragmentary transverse cross-sectional view of the vessel hull of FIG. 24, showing the region where two longitudinal hull subassemblies join one another at the bottom-to-side transition.
Figure 27:
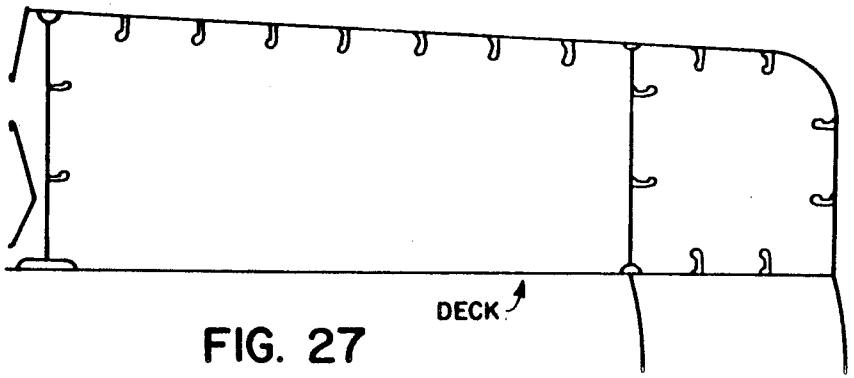
FIG. 27 is an enlarged scale fragmentary transverse cross-sectional view of the vessel hull of FIG. 24, showing the region where a longitudinal hull subassembly joins the underside of the outer margin of the deck structure (which may be conventional, as may be the bow and stern sections of the vessel).
Figure 25:
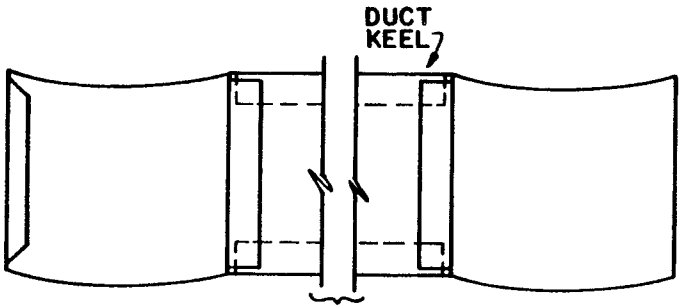
FIG. 25 is an enlarged scale fragmentary transverse cross-sectional view thereof showing the region where two longitudinal hull subassemblies join a duct keel.

The module 124 floating on its bulkhead is moved by tug to a location convenient to the module joining facility 126 (FIG. 20). The 350-ton floating derrick 110 is attached to lifting pads 128 on the deck structure (FIG. 18A) located to provide a horizontal keel for the module 124 after erection (i.e., after tilting over to a horizontal orientation), considering weight and buoyancy distribution (FIG. 18E). The derrick 110 is used to keep a lifting strain on the module throughout erection.

For erecting the module 124 that is floating on its bulkhead, its inner bottom is flooded with salt water. This heels the module approximately 16 degrees in the direction of the inner bottom (FIG. 18B). Water is then progressively pumped into the crotch of the triangle bounded by the bulkhead and the innerbottom tank top (FIGS. 18C and 18D). This water and its free surface causes the module to increasingly heel in the same direction until the water reaches the limit of the tank top at the module's open end (FIG. 18D). From this point on, the lifting capacity of the derrick 110 permits it to complete the erection of the module to a horizontal keel orientation as water is pumped out of the inner bottom to permit the module to be buoyant, once erect (FIG. 18E).

As modules are sequentially assembled and erected afloat, they are moved to the module joining facility 126 (FIGS. 20, 21, 22 and 23) for joining. The module joining facility comprises a module joining grid 130 upon which the entire midbody 132 (at its various stages of completion) is set, with the exception of approximately 20 feet in way of the underwater intermodule joint 133 in the process of being made-up. This latter region rests in a module joining pontoon caisson 134.

The module 124 to growing midbody 132 joining process starts as soon as the first two modules are afloat and erect. They are each towed to the module joining facility and positioned in it, with the butt to be joined between them floating over the module joining pontoon caisson 134, and their other ends on the grid 130 adjoining the pontoon caisson 134. The pontoon caisson has removable chambers (FIG. 23) to permit its width to be varied for different sized ships.

There first two modules are centered over the central grid with the ends between them butting at the longitudinal center of the caisson 130. Water is pumped into the side ballast tanks of both modules 124, which forces submergence of the modules so both are hard aground at high tide on the grid 130, the caisson blocks 136 and the sill gaskets 138. The joint between the caisson sill and the ship's hull is sealed, and the caisson is pumped dry.

Tank tops, bottom shell deck and under deck structural areas of the butt are prepared for welding and welded. Exterior and interior areas in way of the butt where paint is damaged by welding are blasted by the least disruptive and most efficient process (for example Vacublast blasting or dry ice blasting) and painted by the least disruptive process (spray, brush or roller) as welding proceeds. Vertical butt welds joining wing ballast tanks are prepared for welding, welded to the maximum extent using electroslag/electrogas welding procedures, blasted and painted as above. Butts between interior flat panel longitudinals are welded and painted as convenient.

The joined modules are relocated further along the module joining facility 126 as soon as underwater welding and painting is complete (approximately 7 days) by pumping out wing tank ballast, moving the growing midbody 48 feet inboard, reballasting the wing tanks and centering the growing midbody hard aground on the grid 130. Then, the next module 124 is erected in the caisson and the above process is repeated. In this manner, all modules 124 comprising the cargo tanks for a single ship are joined into a single midbody section 132 to be conventionally joined to existing or new bows and sterns in a shipyard graving dock.

In its currently most preferred form, a tanker midbody produced in accordance with the principles of the invention preferably has the shapes and features depicted in FIGS. 24–27.

It should now be apparent that the vessel hull and construction method as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A vessel hull construction, comprising:

a first plurality of outwardly convex, cylindrically arcuate steel plates welded to one another in series at joints along respective adjoining longitudinal edges to provide an outer hull having a bottom and two laterally opposite sides with one interruption located medially of said bottom of said outer hull;

a second plurality of outwardly convex, cylindrically arcuate steel plates, welded to one another in series at joints along respective adjoining longitudinal edges to provide an inner hull having a bottom and two laterally opposite sides with one interruption located medially of said bottom of said inner hull;

said inner hull being arranged within said outer hull so that the bottom of said inner hull spacedly confronts the bottom of said outer hull and the laterally opposite sides of said inner hull spacedly confront the respective laterally opposite sides of said outer hull;

a plurality of longitudinal steel rib plates arranged between said inner and outer hulls and each having an outer longitudinal edge welded in a respective said joint between two plates of said first plurality of steel plates and an inner longitudinal edge welded in a respective said joint between two plates in said second plurality of steel plates;

a medially arranged, longitudinally extending duct keel disposed in both said interruptions and weldedly joined to longitudinal edges of respective adjoining plates of said first and second plurality of steel plates; and a transverse bulkhead located within said inner hull and having an outer perimeter welded to a plurality of the plates of said second plurality of steel plates.

2. The vessel hull construction of claim 1, wherein:

said inner hull and outer hull have two longitudinally opposite ends and said bulkhead is provided at one of said ends of said inner hull.

3. A vessel hull construction, comprising:

a plurality of like modules serially weldedly connected end-to-end to provide a parallel midbody having two opposite ends, each said module comprising:

a first plurality of outwardly convex, cylindrically arcuate steel plates welded to one another in series at joints along respective adjoining longitudinal edges to provide an outer hull having a bottom and two laterally opposite sides with one interruption located medially of said bottom of said outer hull;

a second plurality of outwardly convex, cylindrically arcuate steel plates, welded to one another in series at joints along respective adjoining longitudinal edges to provide an inner hull having a bottom and two laterally opposite sides with one interruption located medially of said bottom of said inner hull;

said inner hull being arranged within said outer hull so that the bottom of said inner hull spacedly confronts the bottom of said outer hull and the laterally opposite sides of said inner hull spacedly confront the respective laterally opposite sides of said outer hull;

a plurality of longitudinal steel rib plates arranged between said inner and outer hulls and each having an outer longitudinal edge welded in a respective said joint between two plates of said first plurality of steel plates and an inner longitudinal edge welded in a respective said joint between two plates in said second plurality of steel plates;

a medially arranged, longitudinally extending duct keel disposed in both said interruptions and weldedly joined to longitudinal edges of respective adjoining plates of said first and second plurality of steel plates;

a transverse bulkhead located within said inner hull and having an outer perimeter welded to a plurality of the plates of said second plurality of steel plates; and said inner hull and outer hull having two longitudinally opposite ends and said bulkhead being provided at one of said ends of said inner hull.

4. The vessel hull construction of claim 3, further comprising:

a vessel hull bow section weldedly connected to one end of said midbody and a vessel hull stern section weldedly connected to the opposite end of said midbody.

5. The vessel hull construction of claim 1, wherein:

each rib plate is provided on one face thereof with a plurality of laterally projecting kick plate stiffeners spaced from one another longitudinally of said inner and outer hulls and each extending from adjacent said inner hull to adjacent said outer hull.

6. The vessel hull construction of claim 5, wherein:

each rib plate is provided with at least one lightening hole opening therethrough laterally of said inner and outer hulls longitudinally between a respective adjacent two of said kick plate stiffeners.

7. The vessel hull construction of claim 1, wherein:

said inner and outer hulls and rib plates are constituted of four substantially identical subassemblies, comprising: starboard and port bottom subassemblies which are mirror images of one another, respectively joined edgewise with said duct keel and with starboard and port sidewall subassemblies which are mirror images of one another.

8. The vessel hull construction of claim 7, further comprising:

said sides of said inner and outer hulls having upper edges and a deck structure bridging between and connecting said starboard and port sidewall assemblies at said upper edges of said inner and outer hulls.

9. The vessel hull construction of claim 7, wherein:

at respective transitions between the bottom and sides of each of said inner and outer hulls said inner and outer hulls have bilge radii which approximate in size the radii of curvature of others of said cylindrically arcuate steel plates in respective of said hulls, including ones both adjacent to and remote from said transitions.

10. A parallel midbody for a double-hulled vessel, comprising:

a first set of at least two steel plates each of which is substantially rectangular in plan so as to have two long edges and two short edges, and curved by being arcuate about an axis that is substantially parallel to said long edges, said first set of steel plates being arranged long edge adjacent to long edge to form respective parts of an outer hull, with said curved plates each being convex outwards throughout the entire width thereof from one said long edge thereof to the other said long edge thereof;

a second set of at least two steel plates each of which is substantially rectangular in plan so as to have two long edges and two short edges, and curved by being arcuate about an axis that is substantially parallel to said long edges of said plates of said second set of steel plates, said second set of steel plates being arranged long edge to adjacent long edge to form respective parts of an inner hull, with said curved plates of said second set each being convex outwards throughout the entire width thereof from one said long edge thereof to the other said long edge thereof;

said second set of steel plates being arranged in spacedly confronting relation to said first set of steel plates, with respective adjacent long edges of steel plates in said second set substantially aligned with and laterally in substantially registration with respective adjacent long edges of steel plates in said first set to provide at least one plate-to-plate joint site for each of said outer and inner hulls;

a third set of at least one steel plate, each of which is substantially rectangular in plan so as to have two long edges and two short edges;

each steel plate of said third set being arranged between said inner and outer hulls with one said long edge thereof juxtaposed with a plate-to-plate joint site of said outer hull, and the other said long edge thereof juxtaposed with a corresponding plate-to-plate joint site of said inner hull, so that three long edges of three different ones of said plates are juxtaposed at each said plate-to-plate joint site;

at each said plate-to-plate joint site, the respective said three long edges being welded together to provide a respective welded T-joint; and a transverse bulkhead having an outer perimeter welded to a plurality of the steel plates of said second set.

11. A longitudinal subassembly fixture for fabricating like bottom and side subassemblies for modules for a parallel midbody for a double hull vessel, said fixture comprising:

three rows of vertical towers having fixed bases, including one inner row, and two outer rows located on opposite sides of said inner row;

each tower in said inner row having four working faces, including two facing respective ones of said outer rows, and two facing in opposite directions along said inner row;

each tower in said outer rows having one working face facing towards said inner row;

each working face having mounted thereto a respective frame means arranged in pairs such that each frame means on a tower in an outer row spacedly confronts a frame means on a tower in said inner row, and such that each frame means on an inner row tower which is provided on a face which faces along said inner row spacedly confronts another said frame means on an adjacent said inner row tower;

each frame means in each pair being mounted to the respective tower by jack means for movement towards and away from the respective tower, so that within each pair of frame means, each frame means can be forced into closer relation with the other and released to move away from the other;

within each pair of frame means, the two respective frame means being provided with complementary surfaces for engaging and holding between them with a predetermined shape and spatial orientation a respective plate; and means mounted to said towers for welding vertical T-joints between respective abutting edges of respective groups of three plates while two of such plates are engaged and held between adjoining pairs of frames means respectively mounted one frame means to a tower in said inner row and a tower in said outer row and while the other one of such plates is engaged and held between a respective pair of frame means respectively mounted one frame means each to two adjoining towers in said inner row.

12. The longitudinal subassembly fixture of claim 11, wherein:

each said pair of frame means which includes one frame means mounted to a tower in an outer row and another frame means mounted to a tower in said inner row has said complementary surfaces thereof configured for engaging and holding a plate which is cylindrically arcuate about a vertical axis.

13. The longitudinal subassembly fixture of claim 12, wherein:

the pairs of said frame means which are mounted between the towers in one of said outer rows and the towers in said inner row, and the pairs of said frame means which are mounted between the towers in the other of said outer rows and the towers in said inner row all have the complementary surfaces thereof oriented to hold respective curved plates so that the curvatures thereof are all convex in the same direction.

14. The longitudinal subassembly fixture of claim 11, wherein:

said means for welding vertical T-joints comprises, for each T-joint, a vertically travelling electroslag welder, and two cooling shoes, one mounted at each of two respective corners of adjoining ones of said inner row towers.

15. Apparatus for assembling a bulkhead with a plurality of longitudinal subassemblies for a module for a parallel midbody for a double hull vessel to provide said module, comprising:

an underwater grid of upright pilings providing a submerged support surface means;

a variable buoyancy barge overlying said submerged support surface means and being adjustable between a floating mode in which said barge is floating above said submerged support surface means and therefore is susceptible to being rotated about a vertical axis, and a sink mode, in which said barge is firmly grounded on said submerged support surface means;

means for supporting a horizontally extending bulkhead on said barge;

means for providing a succession of longitudinal subassemblies for a module for a parallel midbody for a double hull vessel laterally adjacent but spaced from said submerged support surface means;

a derrick juxtaposed with both said subassembly providing means and said submerged support surface means said derrick being of sufficient capacity to lift said subassemblies singly from said subassembly providing means and set each in place on said barge perimetrically of said bulkhead, whereby said barge may be floated and rotated between uses of the derrick to place said subassemblies successively thereon, and may be disposed in said sunk mode while each subassembly is loaded thereonto by said derrick, and whereby said subassemblies may be welded to one another and to said bulkhead while disposed on said barge.

16. The apparatus of claim 15, wherein:

said derrick is a floating derrick.

17. The apparatus of claim 15, wherein:

said submerged support surface means is located near but spaced from a module joining facility arranged for supporting a growing midbody of said modules serially connected in a horizontally extending series as modules are successively joined to said growing midbody;

a body of water communicating said submerged support surface means with said module joining facility, whereby upon completion of assembly of a module on said barge, said barge, with such module thereon, may be floated away from said submerged support surface means and sunk leaving such module floating whereby such module is transferred from a vertical orientation to a horizontal orientation by selectively flooding,.such module with salt water utilizing apparatus of claim 15 and such module in its horizontal orientation floated to juxtaposition with said module joining facility.

18. The apparatus of claim 17, wherein:

said module joining facility includes a horizontally elongated submerged support structure intersected by a pontoon caisson which is constructed and arranged to expose for welding together an end of said transferred module and an end of said growing midbody.

19. A vessel hull construction method, comprising:

(a) providing a first set of cylindrically curved rectangular steel plates serially arranged edge-to-edge, all convex in one direction with all axes of curvature vertically oriented;

(b) providing a second set of cylindrically curved rectangular steel plates serially arranged edge-to-edge, all convex in said one direction with all axes of curvature vertically oriented;

(c) providing a further set of vertically arranged rectangular steel plates each having one longitudinal edge disposed adjacent edges of two adjoining ones of said steel plates in said first set and an opposite longitudinal edge disposed adjacent edges of two adjoining ones of said steel plates in said second set to provide respective T-joint sites;

while holding each said plate by engagement with both opposite faces thereof for maintaining a desired shape and position for each said plate, welding a respective T-joint at each said T-joint site; and (d) releasing said plates from being held, and thereby obtaining a double-walled hull subassembly.

20. The vessel hull construction method of claim 19, further comprising:

(e) repeating steps (a)–(d) a plurality of times to provide a plurality of like subassemblies;

(f) arranging said plurality of said subassemblies in a series around a bulkhead; and (g) welding corresponding edges of corresponding plates on adjoining ones of said subassemblies to one another and welding said subassemblies to said bulkhead to thereby provide a double-hull module having a floor portion and two laterally opposite side portions.

21. The vessel hull construction method of claim 20, wherein:

steps (f) and-(g) are conducted while said steel plates, and therefore said module, remain vertically oriented.

22. The vessel hull construction method of claim 21, wherein:

steps (a)–(e) are conducted in a land-based fixture, and steps (f) and (g) are conducted on board a variable buoyancy barge, with the aid of a floating derrick which successively lifts individual ones of said subassemblies from said fixture and later places them on said barge in said series around said bulkhead; and wherein said barge is sunk onto a fixed support each time a subassembly is to be placed thereon, and between at least sometimes that two subassemblies are successively placed thereon, said barge is increased in buoyancy so as to float above said fixed support and is floatingly shifted in order to bring a site where a next subassembly will be placed, into more convenient disposition relative to said land-based fixture.

23. The vessel hull construction method of claim 19, wherein:

said welding of said T-joints is accomplished by electroslag welding, with cooling being provided along both faces of each plate in said second set as the respective T-joint is being welded.

24. The vessel hull construction method of claim 19, wherein:

said welding of said T-joints is accomplished by electrogas welding, with cooling being provided along both faces of each plate in said second set as the respective T-joint is being welded.

25. The vessel hull construction method of claim 19, wherein:

in step (c), all of said T-joints are simultaneously welded at all of said T-joint sites.

26. The vessel hull construction method of claim 19, wherein:

said holding of step (c) and said releasing of step (d) are respectively accomplished by setting and releasing hydraulically operated horizontally acting jacks mounted to respective towers.

27. The vessel hull construction method of claim 21, further comprising:

(h) repeating steps (a)–(g) a plurality of times to thereby provide a succession of like modules;

(i) tilting-over each module to a horizontal disposition, bottom downwards; and (j) serially welding said modules together end-to-end, thereby providing a double-hulled vessel parallel midbody having two opposite ends.

28. The vessel hull construction method of claim 27, further comprising:

(k) welding a vessel hull bow section to one end of said midbody and a vessel hull stern section to the opposite end of said midbody, thereby providing a double-hulled vessel.

29. The vessel hull construction method of claim 27, wherein:

steps (a)–(e) are conducted in a land-based fixture, and steps (f) and (g) are conducted on board a variable buoyancy barge, with the aid of a floating derrick which successively lifts individual ones of said subassemblies from said fixture and places them on said barge in said series around said bulkhead;

wherein said barge is sunk onto a fixed support each time a subassembly is to be placed thereon, and between at least sometimes that two subassemblies are successively placed thereon, said barge is increased in buoyancy so as to float above said fixed support and is floatingly shifted in order to bring a site where a next subassembly will be placed, into more convenient disposition relative to said land-based fixture; and step (i), conducted successively for each module, comprises sinking said barge differentially flooding the floating module so as to partially tilt the module; temporarily fitting the module with further walls to permit the module to float in a horizontal position; using a derrick to encourage and restrain tilting of the partially tilted module until the module is horizontal and floating.

30. The vessel hull construction method of claim 29, further comprising:

providing a submerged support on which said succession of modules can be subjected to step (j); and, between steps (i) and (j) floating each tilted-over module into place over said submerged support and sinking it onto said submerged support.

31. The vessel hull construction method of claim 30, further comprising:

providing a pontoon-type caisson which intersects said submerged support at an intermediate location along said submerged support, conducting step (j) in said caisson for providing each module-to-module joint, and between providing each two successive module-to-module joints shifting the resultingly growing midbody along said submerged support so as to dispose a respective end of the growing midbody within said caisson.

* * * * *